US010981188B2

(12) United States Patent
DeForest et al.

(10) Patent No.: US 10,981,188 B2
(45) Date of Patent: Apr. 20, 2021

(54) APPARATUSES FOR REMOVING RESIDUE FROM A NOZZLE

(71) Applicant: The Boeing Company, Chicago, IL (US)

(72) Inventors: John J. DeForest, Bothell, WA (US); Fei Cai, Edmonds, WA (US); Cameron J. Moore, Ann Arbor, MI (US); Jeffrey R. Joyce, Livonia, MI (US)

(73) Assignee: The Boeing Company, Chicago, IL (US)

( * ) Notice: Subject to any disclaimer, the term of this patent is extended or adjusted under 35 U.S.C. 154(b) by 143 days.

(21) Appl. No.: 16/424,703

(22) Filed: May 29, 2019

(65) Prior Publication Data

US 2019/0275550 A1 Sep. 12, 2019

Related U.S. Application Data

(62) Division of application No. 15/473,238, filed on Mar. 29, 2017, now Pat. No. 10,357,794.

(51) Int. Cl.

| | |
|---|---|
| ***B05B 15/52*** | (2018.01) |
| ***B08B 1/00*** | (2006.01) |
| ***B08B 9/023*** | (2006.01) |
| ***B05C 5/02*** | (2006.01) |

(52) U.S. Cl.

CPC ..... *B05B 15/52* (2018.02); *B08B 1/00* (2013.01); *B05C 5/02* (2013.01); *B08B 9/023* (2013.01)

(58) Field of Classification Search

CPC ..... B05B 15/50–52; B08B 1/00–04; B08B 9/023

See application file for complete search history.

(56) References Cited

U.S. PATENT DOCUMENTS

| | | | | |
|---|---|---|---|---|
| 9,216,581 | B2 * | 12/2015 | Cyman, Jr. | B41J 2/16544 |
| 2007/0151577 | A1 * | 7/2007 | Lee | B08B 1/007 134/6 |
| 2014/0373779 | A1 * | 12/2014 | Inamasu | B05C 11/00 118/400 |
| 2016/0354797 | A1 * | 12/2016 | Urquhart | B05C 5/02 |

FOREIGN PATENT DOCUMENTS

JP 11165117 A * 6/1999

* cited by examiner

*Primary Examiner* — Michael E Barr
*Assistant Examiner* — Omair Chaudhri
(74) *Attorney, Agent, or Firm* — Walters & Wasylyna LLC

(57) ABSTRACT

An apparatus for removing a residue of a substance, extrudable through a nozzle of an automated end-effector, from an exterior of the nozzle is disclosed. The apparatus comprises a dispenser. The dispenser comprises a platform to support at least one cleaning pad. The dispenser further comprises a cage to maintain at least the one cleaning pad on the platform. The platform is movable relative to the cage. The apparatus also comprises a constricting device to circumferentially squeeze one of at least the one cleaning pad, adhesively picked up from the platform by the nozzle, around the nozzle once the nozzle is inserted into the constricting device. The apparatus additionally comprises a disposal receptacle to collect the one of at least the one cleaning pad, released from the constricting device.

20 Claims, 17 Drawing Sheets

APPARATUSES FOR REMOVING RESIDUE FROM A NOZZLE

PRIORITY

This application is a divisional of U.S. Ser. No. 15/473,238 filed on Mar. 29, 2017.

TECHNICAL FIELD

The present disclosure relates to apparatuses and methods for removing residue of a substance, extrudable through a nozzle of an automated end-effector, from an exterior of the nozzle.

BACKGROUND

A substance may be applied to an article by extrusion of the substance through a nozzle via an automated process. Throughout the process, residue of the substance may build up at the tip of the nozzle. This residue may interfere with the flow of the substance from the tip of the nozzle and/or may negatively affect the shape of the extrusion. Accordingly, the nozzle must be manually cleaned at various junctures throughout the application process. The precautions associated with the need to utilize manual cleaning steps in an otherwise automated process increase cycle time and drive up manufacturing costs.

SUMMARY

Accordingly, apparatuses and methods, intended to address at least the above-identified concerns, would find utility.

The following is a non-exhaustive list of examples, which may or may not be claimed, of the subject matter according to the invention.

One example of the subject matter according to the invention relates to an apparatus for removing a residue of a substance, extrudable through a nozzle of an automated end-effector, from an exterior of the nozzle. The apparatus comprises a dispenser. The dispenser comprises a platform to support at least one cleaning pad. The dispenser also comprises a cage to maintain at least the one cleaning pad on the platform. The platform is movable relative to the cage. The apparatus also comprises a constricting device to circumferentially squeeze one of at least the one cleaning pad, adhesively picked up from the platform by the nozzle, around of the nozzle once the nozzle is inserted into the constricting device. The apparatus additionally comprises a disposal receptacle to collect the one of at least the one cleaning pad, released from the constricting device.

Use of the apparatus, as set forth above, allows for automated cleaning of the residue of the substance from the exterior of the nozzle. Automated cleaning of the residue from the nozzle reduces, or eliminates, interruption of an automated process of application of the substance using the automated end effector. The cage retains the cleaning pad on the platform. The platform automatically, and repeatably, positions the cleaning pad into contact with the nozzle. The constricting device automatically, and repeatably, removes, or cleans, the residue from the exterior of the nozzle, for example, between sequential applications of the substance. The constricting device circumferentially squeezes the cleaning pad around the exterior of at least a portion of the nozzle upon insertion of the nozzle, with the cleaning pad adhered thereto, into the constricting device. The residue is removed from the nozzle upon withdrawal of the nozzle from the cleaning pad that is circumferentially squeezed around the nozzle by the constricting device.

Another example of the subject matter according to the invention relates to a method for removing a residue of a substance, extrudable through a nozzle of an automated end-effector, from an exterior of the nozzle. The method comprises establishing contact between the nozzle and a cleaning pad. The method also comprises adhering the cleaning pad to the nozzle. The method further comprises inserting the nozzle, with the cleaning pad adhered thereto, into a constricting device. The method additionally comprises circumferentially squeezing the cleaning pad around the nozzle with the constricting device. The method also comprises withdrawing the nozzle from the constricting device to separate the cleaning pad from the nozzle and remove the residue of the substance from the exterior of the nozzle. The method further comprises transferring the cleaning pad from the constricting device to a disposal receptacle.

The method, as set forth above, provides for automated cleaning of the residue of the substance from the exterior of the nozzle. Automated cleaning of the residue from the nozzle reduces, or eliminates, interruption of an automated process of application of the substance using the automated end effector.

BRIEF DESCRIPTION OF THE DRAWINGS

Having thus described one or more examples of the invention in general terms, reference will now be made to the accompanying drawings, which are not necessarily drawn to scale, and wherein like reference characters designate the same or similar parts throughout the several views, and wherein:

FIG. 1 is a block diagram of an apparatus for removing a residue of a substance, extrudable through a nozzle of an automated end-effector, from an exterior of the nozzle, according to one or more examples of the present disclosure;

FIG. 2 is a schematic, side elevation view of the apparatus of FIG. 1, according to one or more examples of the present disclosure;

FIG. 3 is a schematic, sectional perspective view of the apparatus of FIG. 1, according to one or more examples of the present disclosure;

FIG. 4 is a schematic, perspective view of the apparatus of FIG. 1, according to one or more examples of the present disclosure;

FIG. 5 is a schematic, sectional side elevation view of a dispenser and a predetermined number of cleaning pads of the apparatus of FIG. 1, according to one or more examples of the present disclosure;

FIG. 6 is a schematic, side elevation view of a cleaning pad adhered to the nozzle and a pad sensor of the apparatus of FIG. 1, according to one or more examples of the present disclosure;

FIG. 7 is a schematic, sectional side elevation view of a constricting device of the apparatus of FIG. 1 in an open position, according to one or more examples of the present disclosure;

FIG. 8 is a schematic, sectional side elevation view of the constricting device of FIG. 7 in a closed position, according to one or more examples of the present disclosure;

FIG. 9 is a schematic, sectional side elevation view of a constricting device of the apparatus of FIG. 1 in an open position, according to one or more examples of the present disclosure;

FIG. 10 is a schematic, sectional side elevation view of the constricting device of FIG. 9 in a closed position, according to one or more examples of the present disclosure;

FIG. 11 is a schematic, sectional side elevation view of a constricting device of the apparatus of FIG. 1 in an open position, according to one or more examples of the present disclosure;

Figure 1:
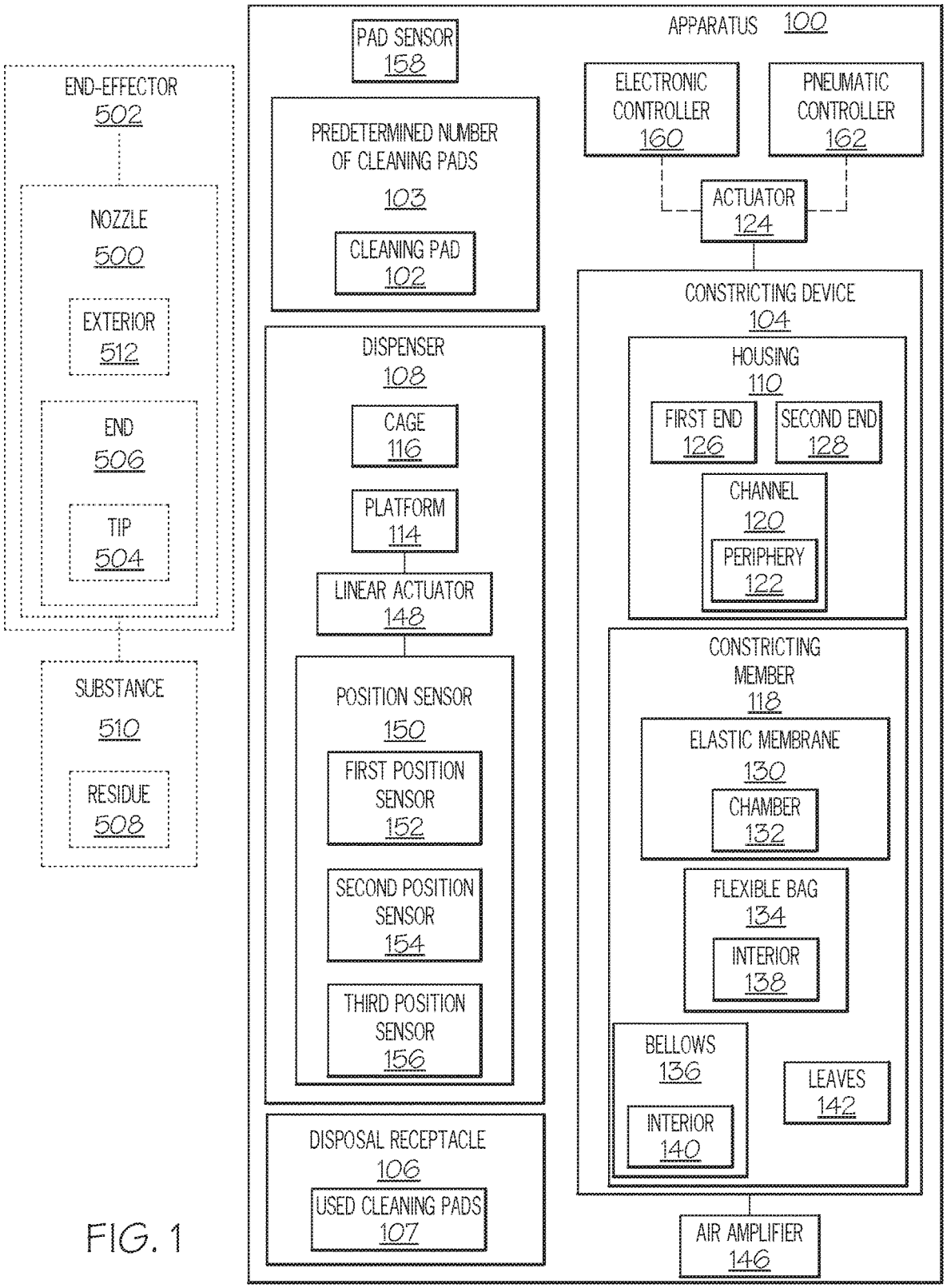
Figure 11:
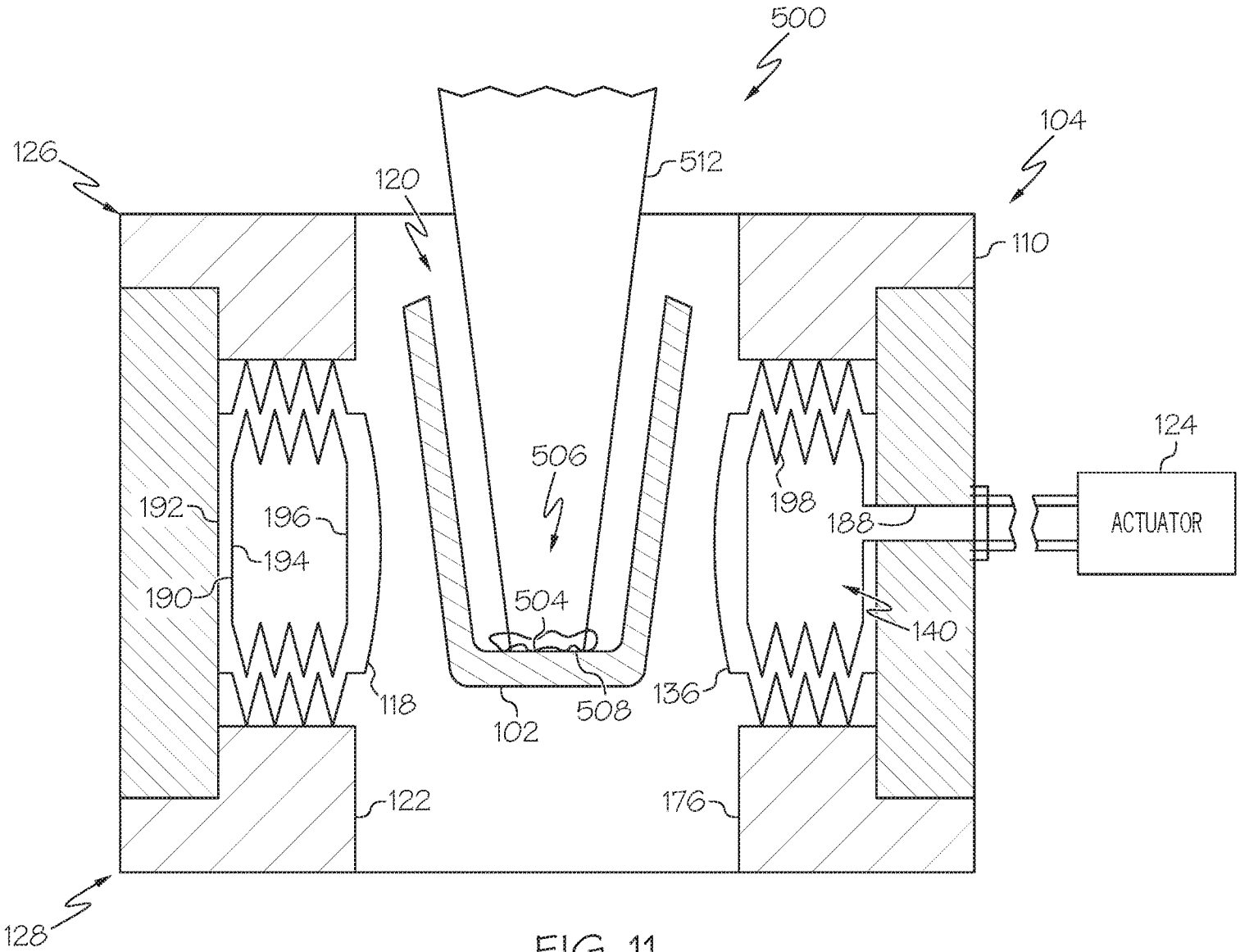
Figure 12:
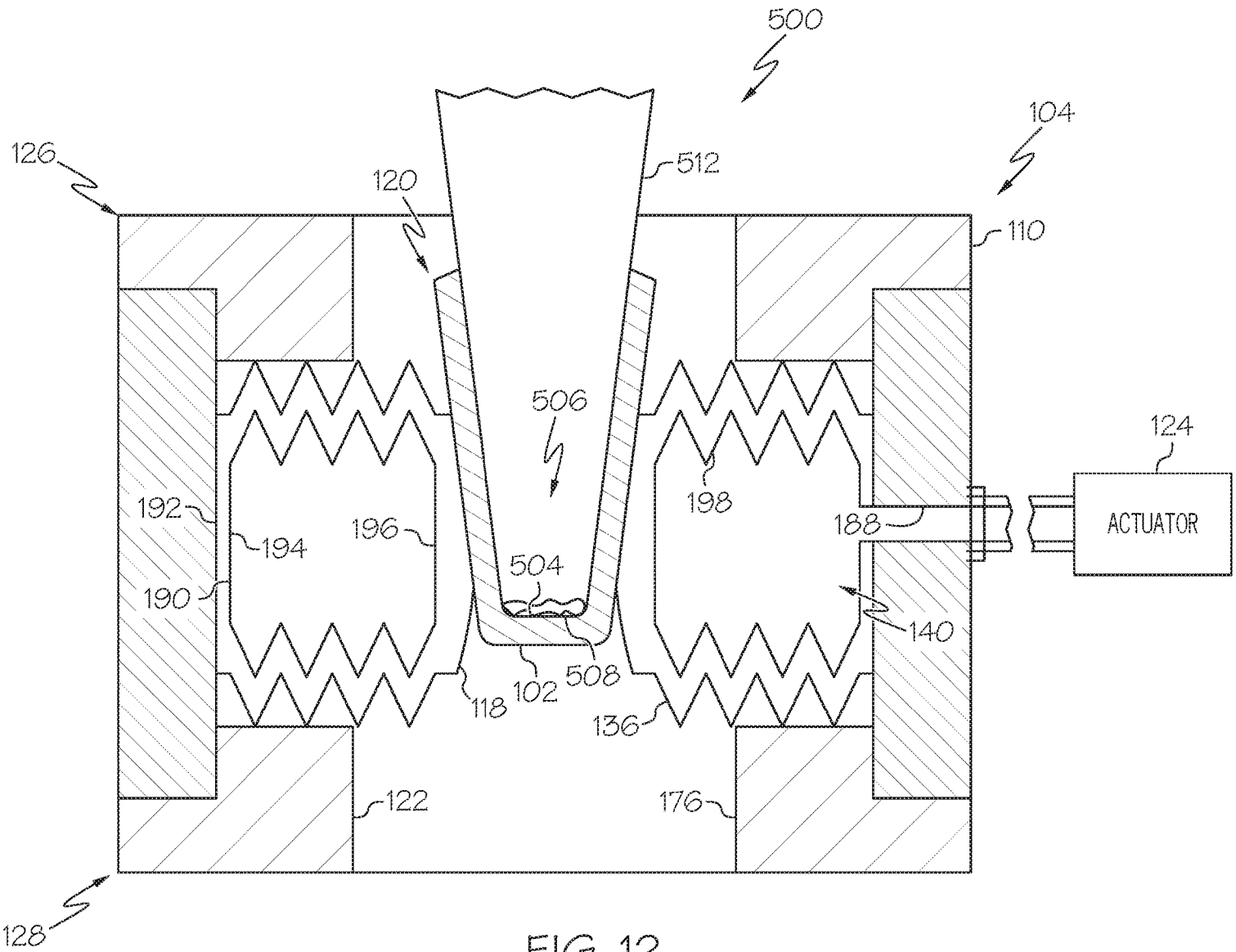
Figure 13:
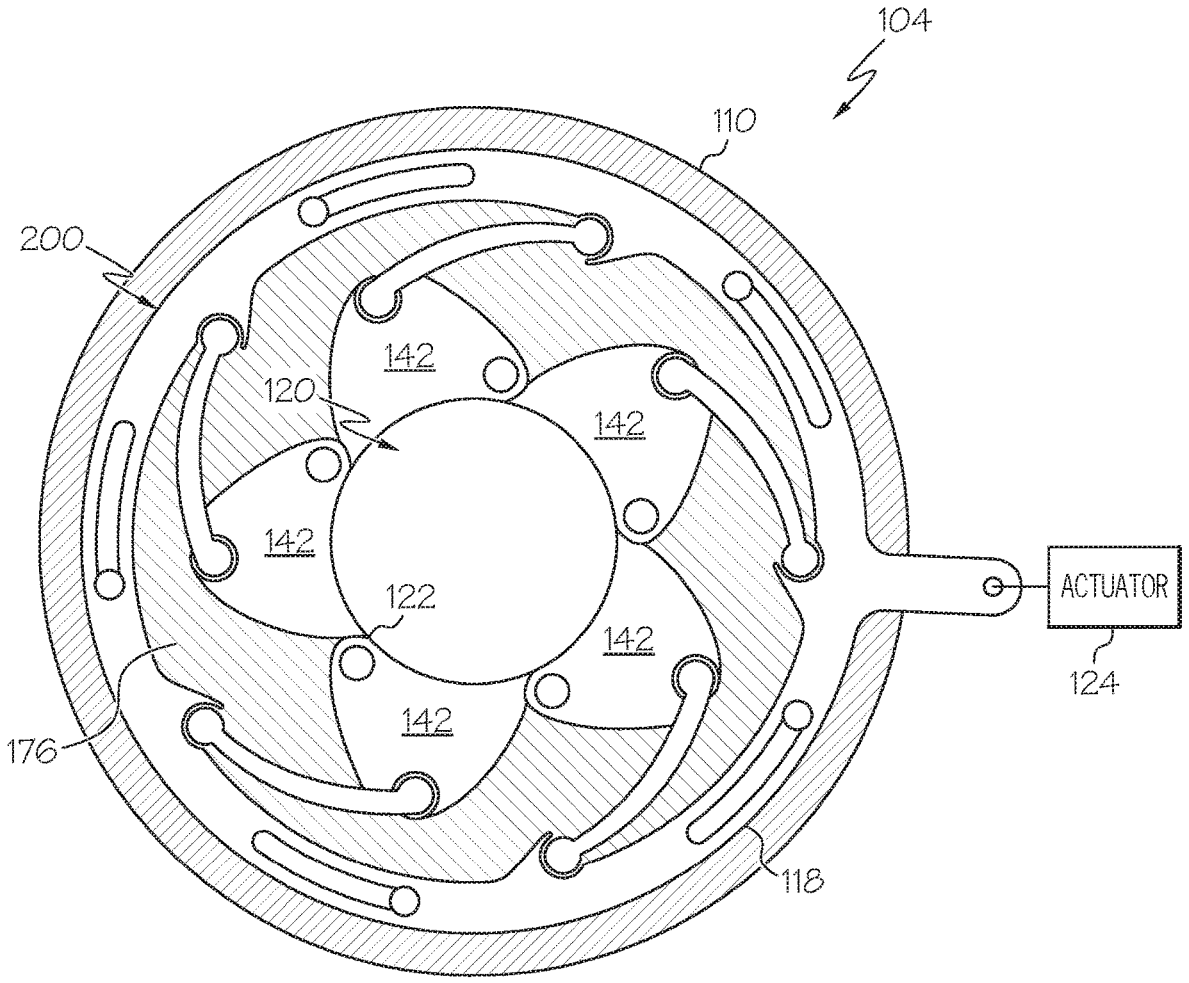
Figure 14:
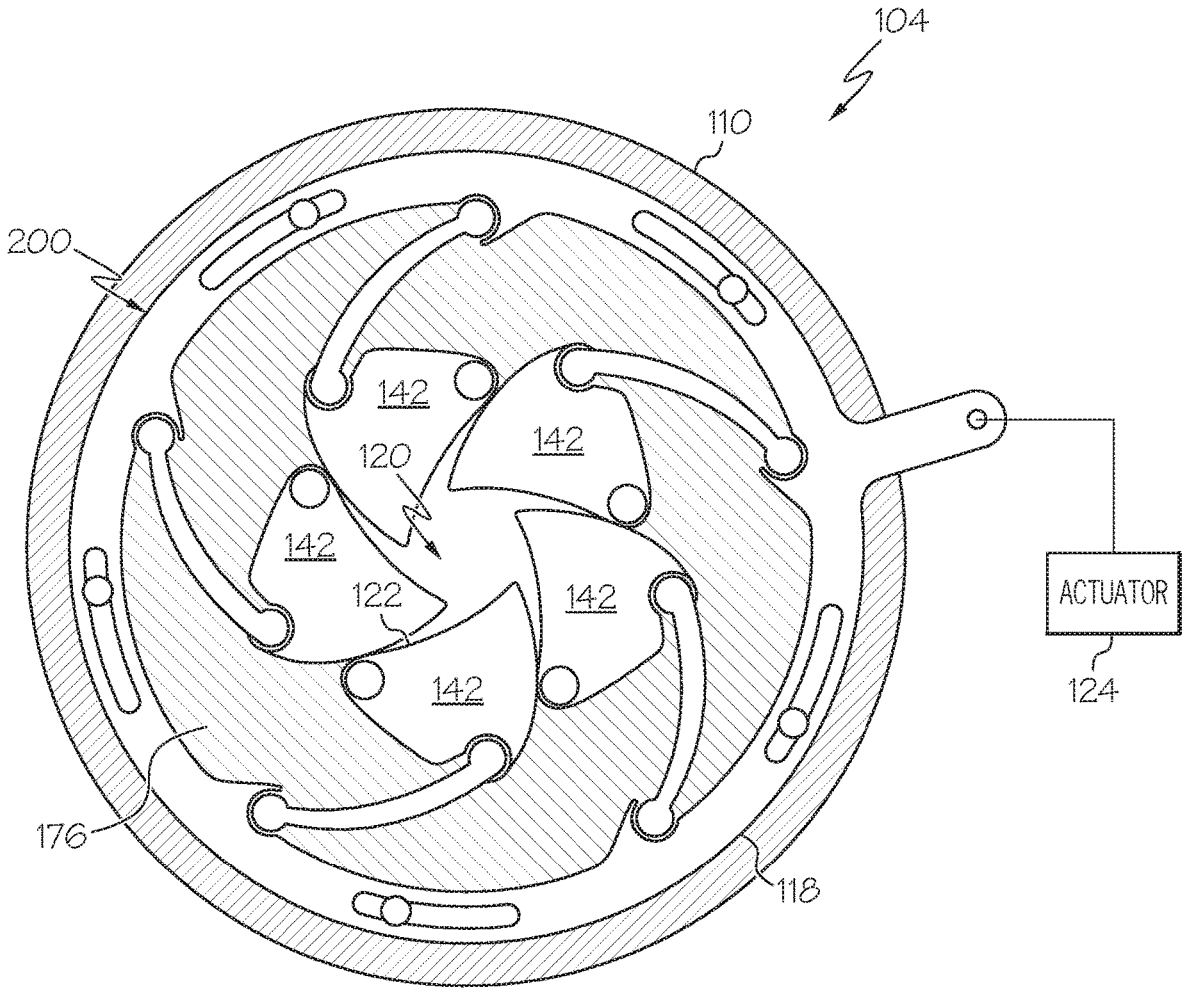
Figure 15A:
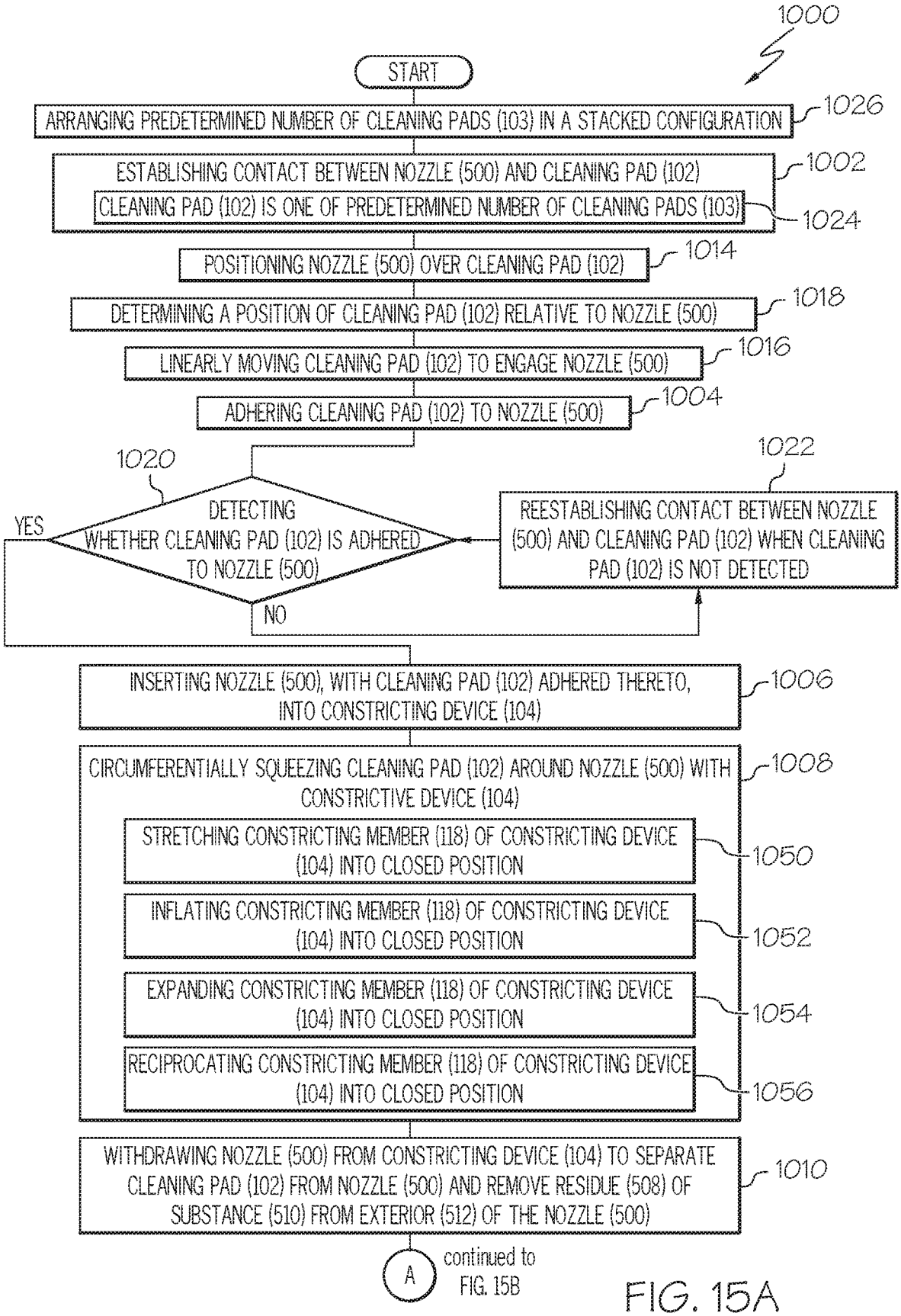
Figure 15B:
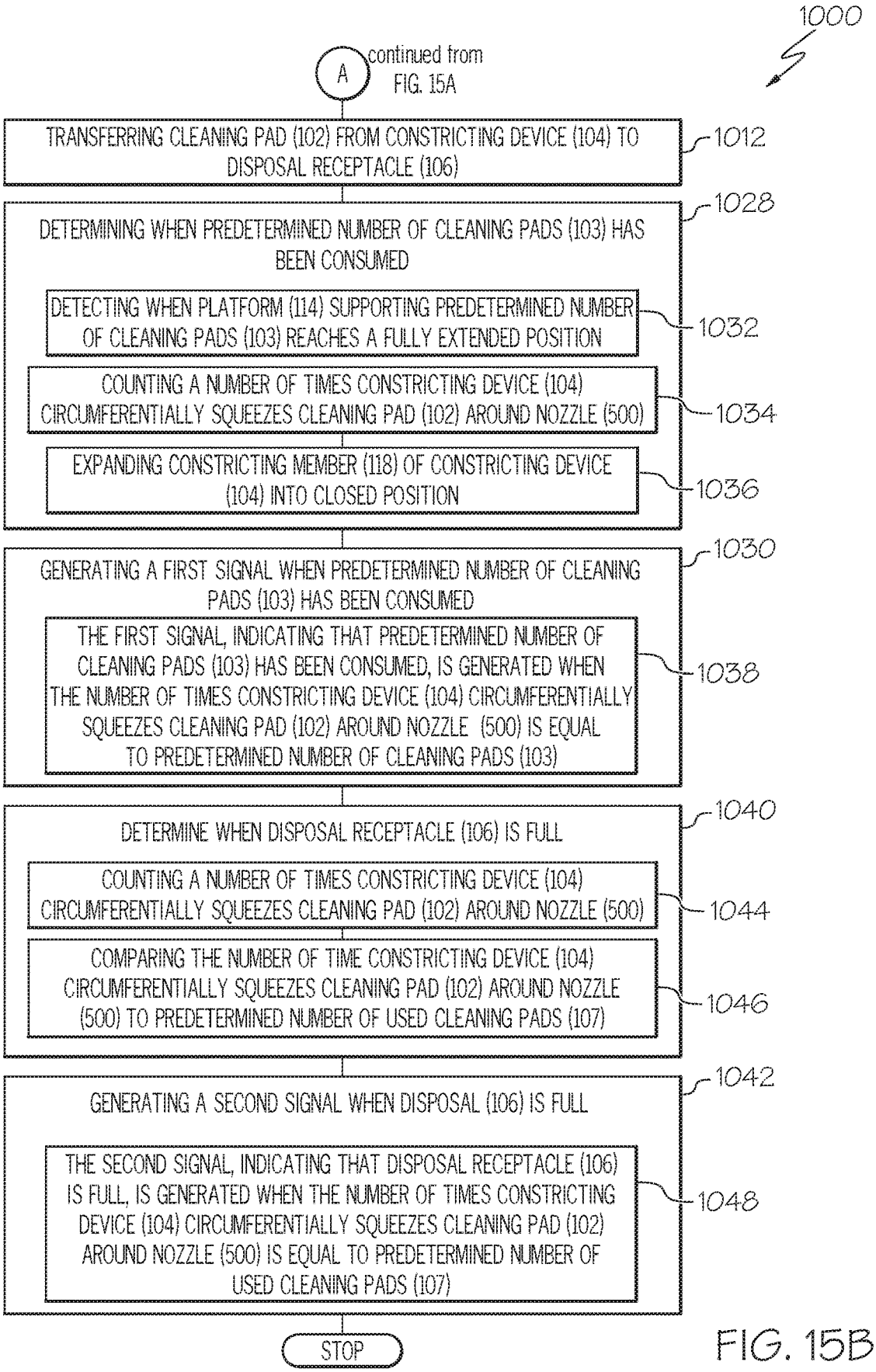
Figure 16:
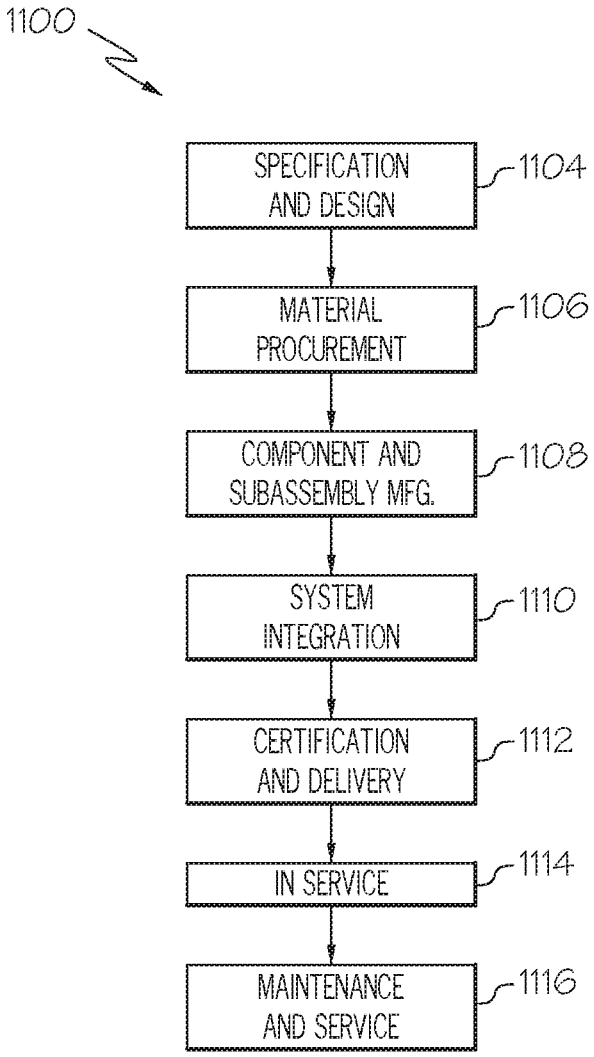
Figure 17:
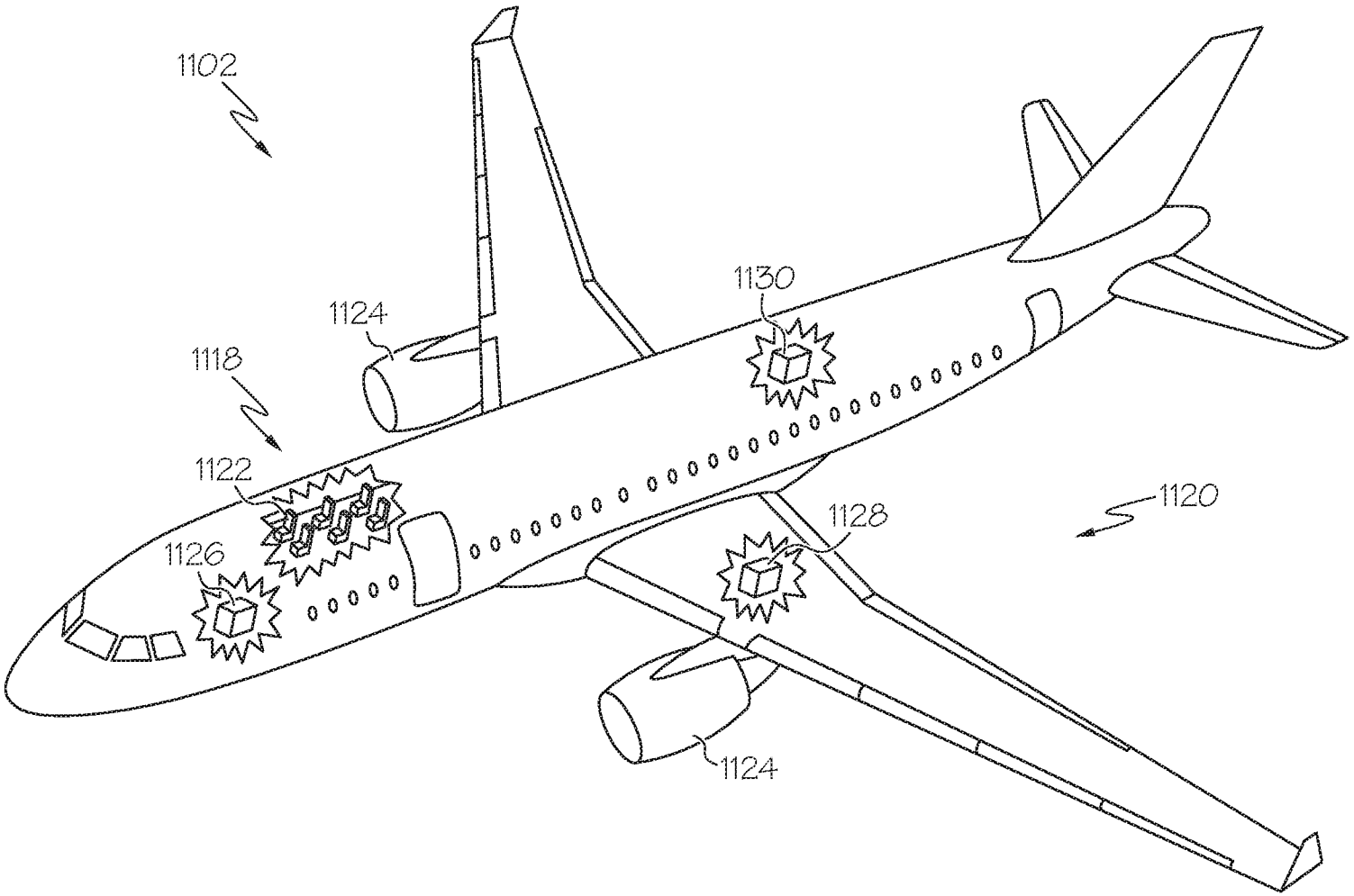

FIG. 12 is a schematic, sectional side elevation view of the constricting device of FIG. 11 in a closed position, according to one or more examples of the present disclosure;

FIG. 13 is a schematic, sectional top plan view of a constricting device of the apparatus of FIG. 1 in an open position, according to one or more examples of the present disclosure;

FIG. 14 is a schematic, sectional top plan view of the constricting device of FIG. 13 in a closed position, according to one or more examples of the present disclosure;

FIG. 15A and FIG. 15B collectively are a block diagram of a method for removing a residue of a substance, extrudable through a nozzle of an automated end-effector, from an exterior of the nozzle utilizing the apparatus of FIG. 1, according to one or more examples of the present disclosure;

FIG. 16 is a block diagram of aircraft production and service methodology; and FIG. 17 is a schematic illustration of an aircraft.

DETAILED DESCRIPTION

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

In FIGS. 15A, 15B, and 16, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 15A, 15B, and 16 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware, which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIG. 1 and particularly to, e.g., FIGS. 2-14, apparatus 100 for removing residue 508 of substance 510, extrudable through nozzle 500 of automated end-effector 502, from exterior 512 of nozzle 500 is disclosed. Apparatus 100 comprises dispenser 108. Dispenser 108 comprises platform 114 to support at least one cleaning pad 102. Dispenser 108 also comprises cage 116 to maintain at least one cleaning pad 102 on platform 114. Platform 114 is movable relative to cage 116. Apparatus 100 also comprises constricting device 104 to circumferentially squeeze one of at least one cleaning pad 102, adhesively picked up from platform 114 by nozzle 500, around of nozzle 500 once nozzle 500 is inserted into constricting device 104. Apparatus 100 additionally comprises disposal receptacle 106 to collect one of at least one cleaning pad 102, released from constricting device 104. The preceding subject matter of this paragraph characterizes example 1 of the present disclosure.

Use of apparatus 100, as set forth above, allows for automated cleaning of residue 508 of substance 510 from exterior 512 of nozzle 500. Automated cleaning of residue 508 from nozzle 500 reduces, or eliminates, interruption of an automated process of application of substance 510 using automated end effector 502. Cage 116 retains cleaning pad 102 on platform 114. Platform 114 automatically, and repeatably, positions cleaning pad 102 into contact with nozzle 500. Constricting device 104 automatically, and repeatably, removes, or cleans, residue 508 from exterior 512 of nozzle 500, for example, between sequential or subsequent applications of substance 510. Constricting device 104 circumferentially squeezes cleaning pad 102 around exterior 512 of at least a portion of nozzle 500 upon insertion of nozzle 500, with cleaning pad 102 adhered thereto, into constricting device 104. Residue 508 is removed from nozzle 500 upon withdrawal of nozzle 500 from cleaning pad 102 that is circumferentially squeezed around nozzle 500 by constricting device 104.

Referring to FIG. 1, substance 510 may include any material that is extrudable through nozzle 500 in order to apply substance 510 to or deposit substance 510 on another article. As examples, substance 510 may be applied to or deposited on a surface of an article, within a joint formed by abutting surfaces of one or more articles, or on a preceding layer of substance 510, for example, previously applied to or deposited on an article.

As used herein, the term "extrudable" has its ordinary meaning as known to those skilled in the art and may include any material that is capable of being pushed, pulled or otherwise forced out from nozzle 500.

As an example, substance 510 may be a viscous material or viscoelastic material that has little or no flow characteristics such that, for example, substance 510 generally stays where it is applied or deposited following extrusion through nozzle 500.

As a specific, non-limiting example, substance 510 may be a sealant. For example, the sealant may be used to block the passage of a fluid (e.g., a mechanical sealant), sound (e.g., an acoustic sealant), or electricity (e.g., electrical or electrostatic sealant) through a surface, a joint, or an opening in a material. As examples, the sealant may include, or may be made from, resin, epoxy, wax, latex, rubber, silicone, urethane, plastic, polysulfide, polyurethane, metal, and the like.

As another specific, non-limiting example, substance 510 may be an adhesive.

As yet another specific, non-limiting example, substance 510 may be concrete.

Referring to FIGS. 1 and 5-12, nozzle 500 may include any device or mechanism configured to control the direction and/or flow characteristics (e.g., speed, volume, etc.) of substance 510 as substance 510 is extruded, or exits, through tip 504 of nozzle 500. As an example, nozzle 500 includes a tubular body defining an internal passage having a varying cross-sectional area that tapers inwardly toward tip 504 or narrows from a wider diameter (e.g., at a source of substance 510) to a smaller diameter (e.g., at end 506 of nozzle 500) in the direction of a flow of substance 510 (e.g., a convergent nozzle).

Referring still to FIGS. 1 and 5-12, as used herein, residue 508 includes any amount (e.g., a small amount) of substance 510 that remains on nozzle 500, for example, on exterior of nozzle 500, proximate to (e.g., at or near) tip 504 of nozzle 500, after substance 510 has been extruded through nozzle 500 and exits tip 504 of nozzle 500.

Referring to FIGS. 5-12, residue 508 of substance 510 disposed on exterior 512 of nozzle 500 and/or proximate to tip 504 of nozzle 500 provides the means for adhering one of at least one cleaning pad 102 to nozzle 500 upon contact of tip 504 of nozzle 500 with one of at least one cleaning pad 102. As an example, following extrusion of substance 510 through nozzle 500 and application of substance 510 to another article, residue 508 of substance 510 may remain on exterior 512 of nozzle 500. Nozzle 500 is then moved, for example, by automated end-effector 502, to place tip 504 of nozzle 500 into physical contact with cleaning pad 102. Upon contact between tip 504 of nozzle 500 and cleaning pad 102, residue 508 serves as a temporary adhesive to adhere cleaning pad 102 to tip 504 and allow nozzle 500 to pick up cleaning pad 102 and remove cleaning pad 102 from platform 114.

Referring to FIG. 1, automated end-effector 502 may include any device or mechanism located at an end of a robotic arm (not shown) including nozzle 500 or to which nozzle 500 is attached. As an example, automated end-effector 502 may include a tool capable of extruding substance 510 through nozzle 500. The robotic arm may manipulate the position of automated end-effector 502 and, thus, nozzle 500 during automated application of substance 510 and during automated removal of residue 508 of substance 510 from exterior 512 of nozzle 500. A programmable controller (not shown) may be operatively coupled to the robotic arm to control the position of automated end-effector 502 within a three-dimensional Cartesian coordinate system and movement of automated end-effector 502 through three-dimensional space. The programmable controller may also be operatively coupled to automated end-effector 502 to control extrusion of substance 510 through nozzle 500.

Referring to FIGS. 2-5, cage 116 of dispenser 108 is configured to retain at least one cleaning pad 102 on platform 114 of dispenser 108. As an example, cage 116 holds a plurality of cleaning pads in a stacked arrangement or configuration (e.g., a stack of cleaning pads) on platform 114. As an example, the plurality of cleaning pads is predetermined number of cleaning pads 103. Predetermined number of cleaning pads 103 may be any number of cleaning pads, such as a maximum number of cleaning pads that fit in the stacked configuration within cage 116 or a number of cleaning pads that come prepackaged in the stacked configuration. As an example, cage 116 includes a plurality of posts 164 positioned around and proximate to perimeter edge 166 of platform 114 and surrounding the stack of cleaning pads. Cage 116 may also include ring 168 interconnecting outer ends of plurality of posts 164.

Referring to FIGS. 2-5, platform 114 supports at least one cleaning pad 102. As an example, platform 114 supports predetermined number of cleaning pads 103 within cage 116. In an example implementation, at least one cleaning pad 102 is a topmost cleaning pad of the stack of predetermined number of cleaning pads 103. In an example, platform 114 moves (e.g., upwardly or outwardly) relative to cage 116 to position at least one cleaning pad 102 of predetermined number of cleaning pads 103 into contact with tip 504 of nozzle 500. In this example, platform 114 moves at least one cleaning pad 102 into contact with nozzle 500, which is stationary. In another example, platform 114 is biased, for example, by a spring, into a contact position and platform 114 moves (e.g., downwardly or inwardly) relative to cage 116 in response to contact of tip 504 of nozzle 500 with at least one cleaning pad 102. In this example, nozzle 500 moves, for example, by automated end-effector 502, into contact with a stationary one of at least one cleaning pad 102.

Figure 2:
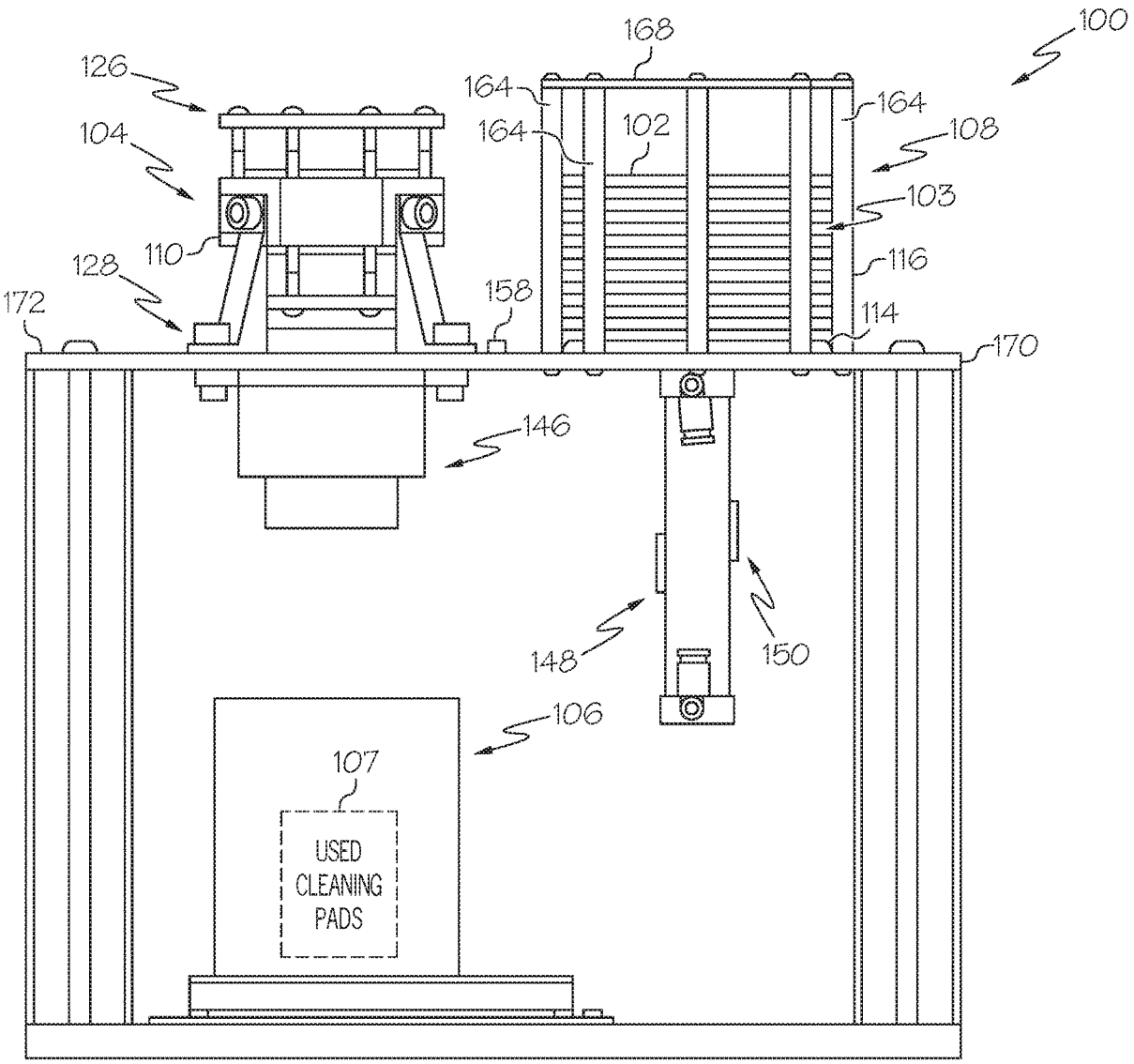
Figure 3:
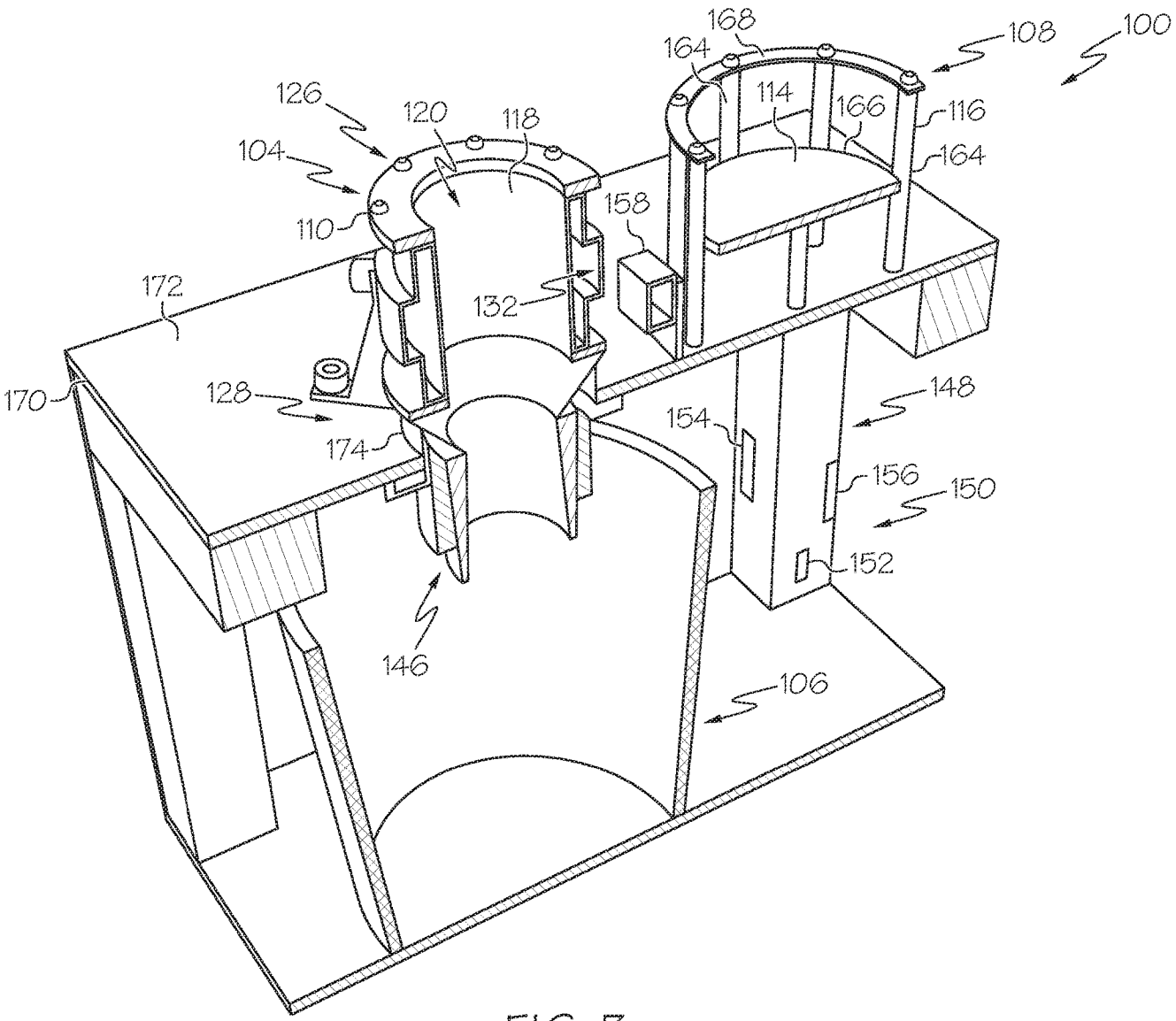
Figure 4:
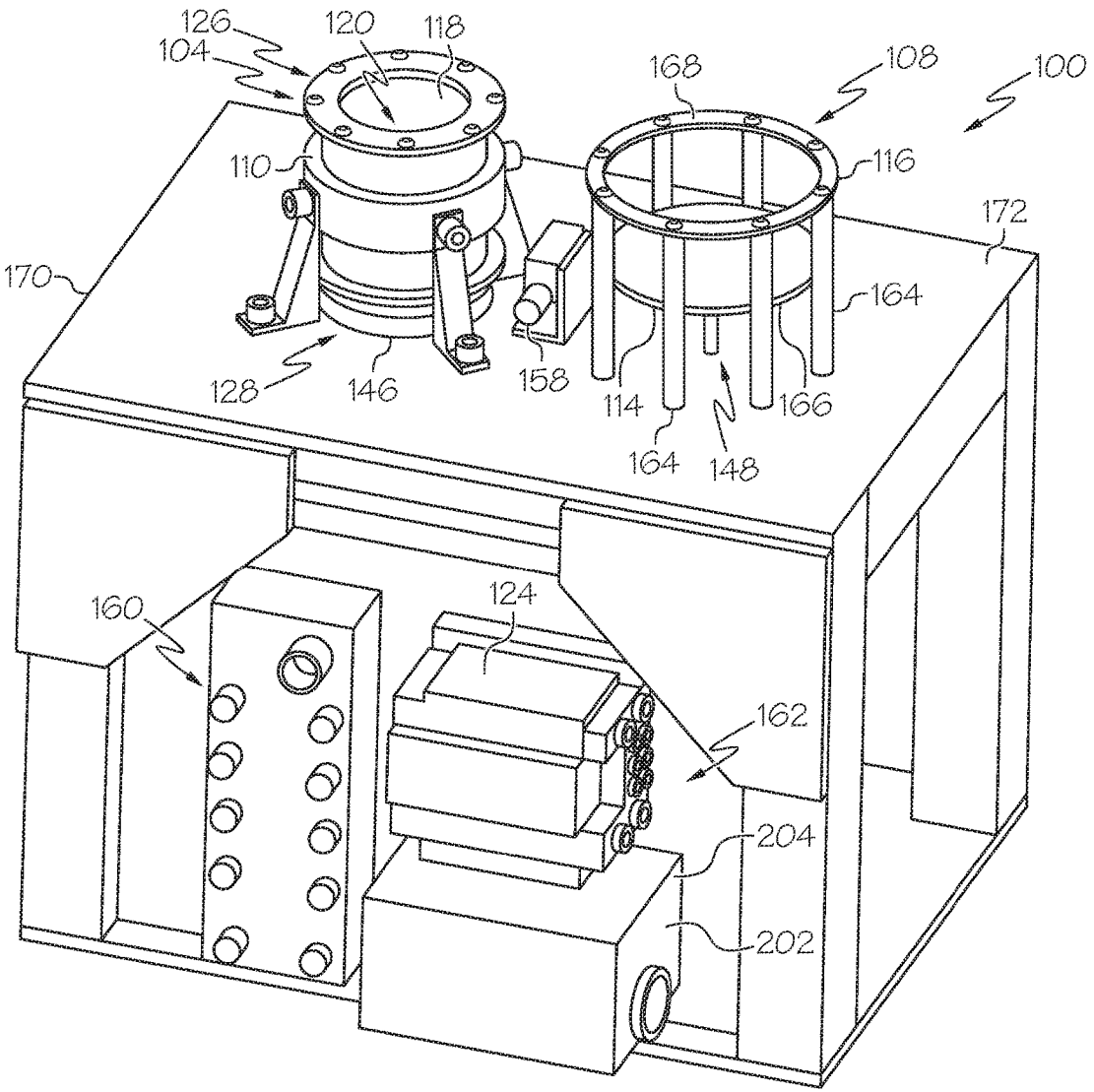

Referring to FIGS. 2-4, in an example, platform 114 and cage 116 are coupled to support base 170. Support base 170 may include any structure suitable to support and position platform 114 and cage 116. As examples, support base 170 can be a workbench, a table, and the like. In an example, cage 116 is connected (e.g., fastened or otherwise mounted) to support surface 172 of support base 170. Platform 114 is movably connected to support surface 172 within cage 116.

Referring to FIGS. 1-4, in an example, disposal receptacle 106 is positioned to receive used cleaning pads 107 released or transferred from constricting device 104 after nozzle 500 is withdrawn from constricting device 104. As an example, disposal receptacle 106 is positioned within support base 170 below constricting device 104. Disposal receptacle 106 may include any structure suitable to receive used cleaning pads 107. As examples, disposal receptacle 106 can be a canister, container, and the like having an open top and defining an interior volume for holding used cleaning pads 107.

As used herein, used cleaning pads 107 refers to a cleaning pad after being circumferentially squeezed around nozzle 500 by constricting device 104 to remove residue 508 of substance 510 from exterior 512 of nozzle 500 and released from constricting device 104.

Referring generally to FIG. 1 and particularly to, e.g., FIGS. 2-4 and 7-12, constricting device 104 comprises housing 110. Housing 110 comprises first end 126, second end 128, and channel 120. Channel 120 extends from first end 126 to second end 128. Constricting device 104 also comprises constricting member 118, coupled to housing 110 and forming at least a portion of periphery 122 of channel 120. Constricting member 118 is movable, relative to housing 110, between an open position to receive nozzle 500, with one of at least one cleaning pad 102 adhered thereto, and a closed position to circumferentially squeeze one of at least one cleaning pad 102 around of nozzle 500. The preceding subject matter of this paragraph characterizes example 2 of the present disclosure, wherein example 2 also includes the subject matter according to example 1, above.

Housing 110 serves to position constricting member 118 for contact with nozzle 500. Channel 120 is defined through housing 110 and provides a passage for nozzle 500 to be inserted into housing 110. Housing 110 circumferentially surrounds nozzle 500, with cleaning pad 102 adhered thereto, when nozzle 500 is inserted within channel 120. Constricting member 118 is positioned within channel 120 and also circumferentially surrounds nozzle 500, with cleaning pad 102 adhered thereto. Constricting member 118 moves relative to housing 110 to engage one of at least one cleaning pad 102 and force one of at least one cleaning pad 102 around exterior 512 of nozzle 500, such that upon removal of nozzle 500 from within constricting device 104, one of at least one cleaning pad 102 wipes residue 508 from exterior 512 of nozzle 500 under the force from constricting member 118.

Referring to FIGS. 7, 9, 11 and 13, in the open position, constricting member 118 is positioned proximate to inner sidewall 176 of housing 110, which defines periphery 122 of channel 120, and is, thus, spaced away from nozzle 500, with cleaning pad 102 adhered thereto, when nozzle 500 is inserted into channel 120.

Referring to FIGS. 8, 10, 12 and 14, in the closed position, constricting member 118 is moved radially inward relative to inner sidewall 176 of housing 110 and, thus, engages cleaning pad 102 and circumferentially squeezes cleaning pad 102 around exterior 512 of nozzle 500. When in the open position, constricting member 118 partially encloses channel 120 by reducing a cross-sectional area of channel 120.

Referring to FIGS. 2-4, in an example, housing 110 of constricting device 104 is coupled to support base 170. As an example, housing 110 is connected (e.g., fastened or otherwise mounted), at second end 128 of housing 110, to support surface 172 of support base 170. As best illustrated in FIG. 3, support base 170 includes pass-through opening 174 formed through support surface 172 and aligned with channel 120 of housing 110. Used cleaning pad 107 is transferred from within channel 120 through pass-through opening 174 and into disposal receptacle 106.

Referring to FIG. 3, in an example, disposal receptacle 106 is positioned in approximate alignment with channel 120 of housing 110 of constricting device 104 and pass-through opening 174 of support base 170, such that used cleaning pad 107 is transferred from channel 120 into disposal receptacle 106.

Referring generally to FIG. 1 and particularly to, e.g., FIGS. 4 and 7-14, apparatus 100 also comprises actuator 124. Actuator 124 is operatively coupled to constricting device 104. Actuator 124 moves constricting member 118 into the closed position. The preceding subject matter of this paragraph characterizes example 3 of the present disclosure, wherein example 3 also includes the subject matter according to example 2, above.

Actuator 124 serves to provide a driving force to actively move constricting member 118 from the open position to the closed position and, thus, to circumferentially squeeze cleaning pad 102 around exterior 512 of nozzle 500 with constricting member 118.

Referring generally to FIG. 1 and particularly to, e.g., FIGS. 7-10, constricting member 118 automatically returns to the open position. The preceding subject matter of this paragraph characterizes example 4 of the present disclosure, wherein example 4 also includes the subject matter according to example 3, above.

Automatic return of constricting member 118 to the open position from the closed position eliminates active repositioning of constricting member 118 back to the open position, for example, by actuator 124 or by another mechanism, following circumferential squeezing of cleaning pad 102 around exterior 512 of nozzle 500 with constricting member 118.

Figure 7:
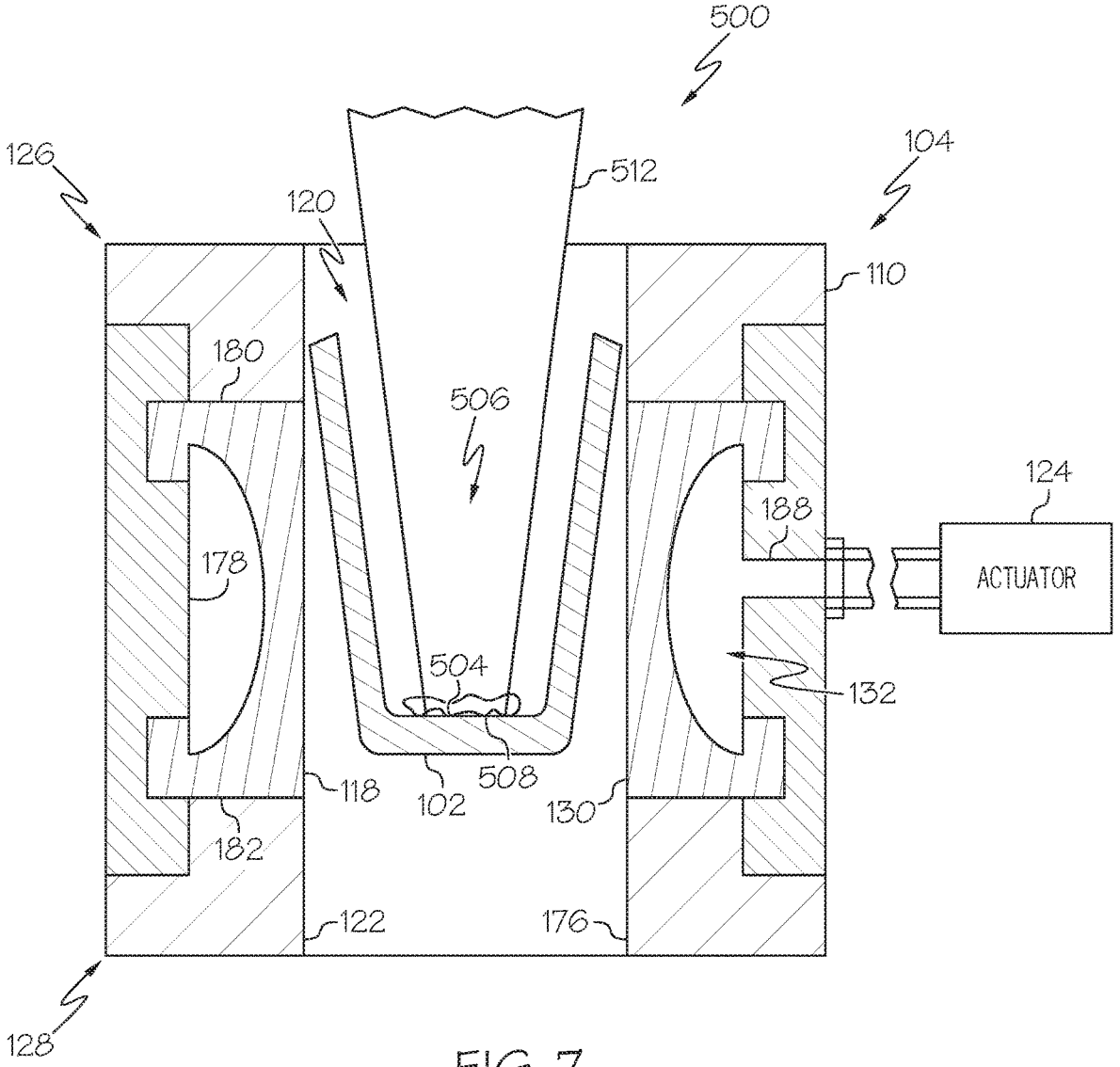
Figure 8:
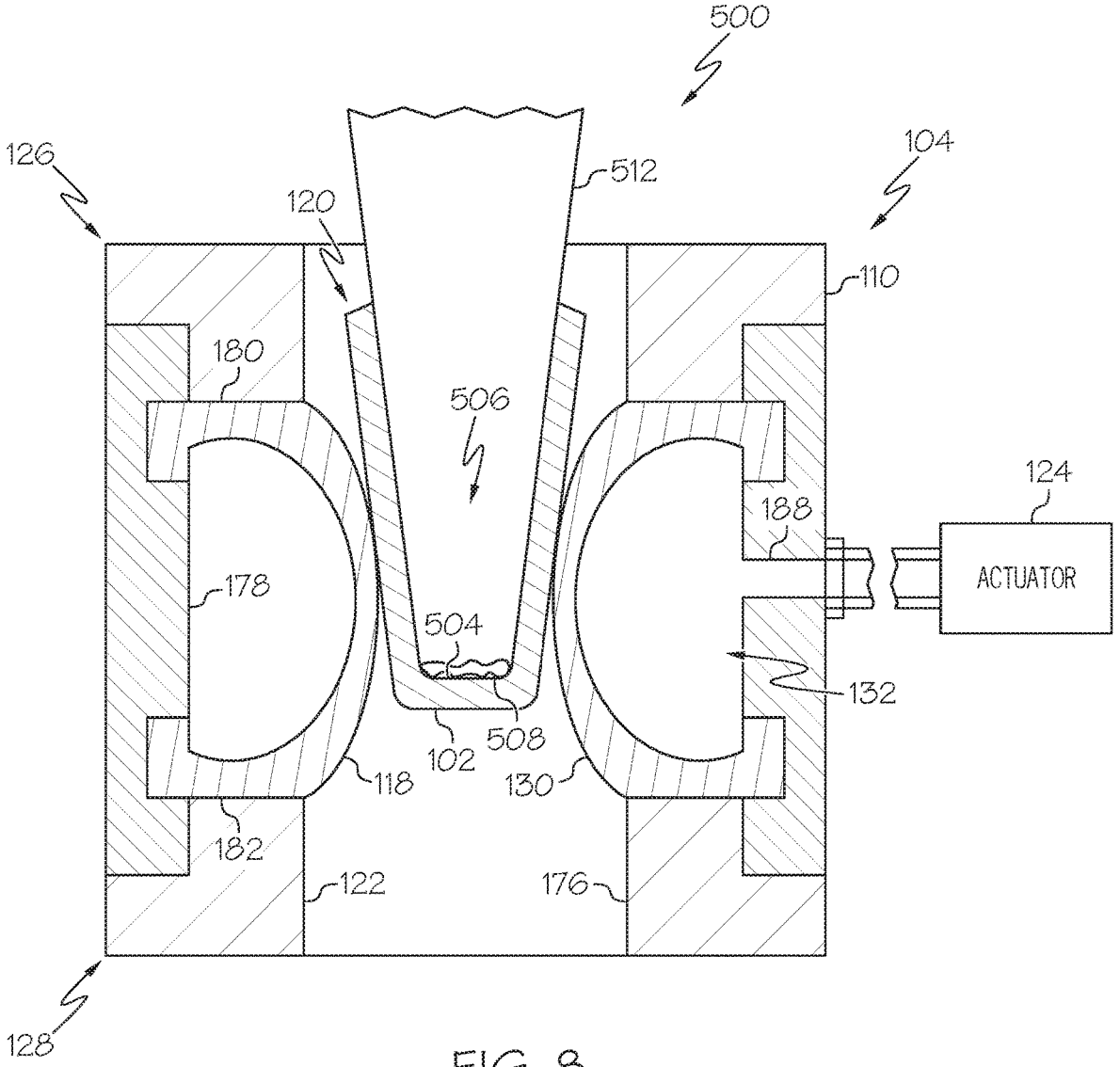

Referring generally to FIG. 1 and particularly to, e.g., FIGS. 7 and 8, constricting member 118 stretches into the closed position and springs back to the open position. The preceding subject matter of this paragraph characterizes example 5 of the present disclosure, wherein example 5 also includes the subject matter according to example 3 or 4, above.

Constricting member 118 being stretchable provides for active movement (e.g., stretching) into the closed position and passive, automatic movement (e.g., springing back) back into the open position.

Referring to FIGS. 7 and 8, as an example, constricting member 118 that is stretchable is biased in the open position.

Engagement of actuator 124 provides the driving force to stretch constricting member 118 into the closed position circumferentially around nozzle 500, with cleaning pad 102 adhered thereto. The driving force continues to maintain constricting member 118 stretched into the closed position until disengagement of actuator 124. Upon disengagement of actuator 124, constricting member 118 automatically returns to the open position.

Referring generally to FIG. 1 and particularly to, e.g., FIGS. 7 and 8, constricting member 118 comprises elastic membrane 130. Elastic membrane 130 is connected to housing 110. Chamber 132 is formed between elastic membrane 130 and housing 110. Actuator 124 forces air within chamber 132 to stretch elastic membrane 130 into the closed position. The preceding subject matter of this paragraph characterizes example 6 of the present disclosure, wherein example 6 also includes the subject matter according to any one of examples 3 to 5, above.

Elastic membrane 130 is biased in the open position and is capable of stretching or expanding into the closed position. Elastic membrane 130 is stretched into the closed position upon application of a pneumatic force or a positive pressure in response to air being forced into chamber 132 by engagement of actuator 124.

Referring to FIGS. 7 and 8, in an example, chamber 132 is defined by an annular recess 178 formed into at least a portion of inner sidewall 176 of housing 110. Elastic membrane 130 includes an annular first edge 180 connected to inner sidewall 176 and an opposed annular second edge 182 connected to inner sidewall 176. Elastic membrane 130 spans across annular recess 178. Chamber 132 is formed between inner sidewall 176 and elastic membrane 130.

Referring still to FIGS. 7 and 8, in an example implementation, engagement of actuator 124 forces air into chamber 132 to create a positive pressure (e.g., increase the pressure) between inner sidewall 176 and elastic membrane 130. The increasing positive pressure expands the volume of chamber 132 and forces elastic membrane 130 into the closed position (e.g., stretches elastic membrane radially inward relative to inner sidewall 176 to partially enclose, or reduce the cross-sectional area of, channel 120) in order to circumferentially squeeze cleaning pad 102 around exterior 512 of nozzle 500, as best illustrated in FIG. 8. Disengagement of actuator 124 allows air to escape from within chamber 132 to reduce the pressure between inner sidewall 176 and elastic membrane 130. The reduced pressure allows elastic membrane 130 to automatically return to its original, open position, as best illustrated in FIG. 7.

Referring generally to FIG. 1 and particularly to, e.g., FIGS. 7 and 8, elastic membrane 130 is made of latex. The preceding subject matter of this paragraph characterizes example 7 of the present disclosure, wherein example 7 also includes the subject matter according to example 6, above.

Latex provides elastic membrane 130 with a suitably large stretch, or expansion, ratio for circumferentially squeezing nozzle 500, with cleaning pad 102 attached thereto. Latex also provides elastic membrane 130 with suitable flexibility and resiliency for numerous stretch-and-return cycles and, thus, enables a long life for constricting member 118 before repair or replacement is needed.

In other examples, elastic membrane 130 may be made from another natural rubber or synthetic rubber.

Referring generally to FIG. 1 and particularly to, e.g., FIGS. 7 and 8, elastic membrane 130 has a thickness of approximately 1.5 mm. The preceding subject matter of this paragraph characterizes example 8 of the present disclosure, wherein example 8 also includes the subject matter according to example 6 or 7, above.

Elastic membrane 130 that has a relatively small thickness allows a relatively low positive pressure applied within chamber 132 to stretch elastic membrane 130 into the closed position.

As an example, an elastic membrane 130 having a thickness of approximately 1.5 mm (0.05 inch) allows a pressure of approximately 5 psi to approximately 10 psi applied within chamber 132 to stretch elastic membrane 130 into the closed position.

In other examples, elastic membrane 130 may have various other thicknesses, for example, ranging from approximately 0.5 mm to 2 mm. In yet other examples, elastic membrane 130 may have a variable thickness along its width, for example, between annular first edge 180 and annular second edge 182. As an example, elastic membrane 130 may include a thicker portion proximate to annular first edge 180 (e.g., at or near a first end of elastic membrane 130) and/or a thicker portion proximate to annular second edge 182 (e.g., at or near a second end of elastic membrane 130) for attachment to inner sidewall 176 and a thinner portion located between annular first edge 180 and annular second edge 182 for stretching into the closed position.

Figure 9:
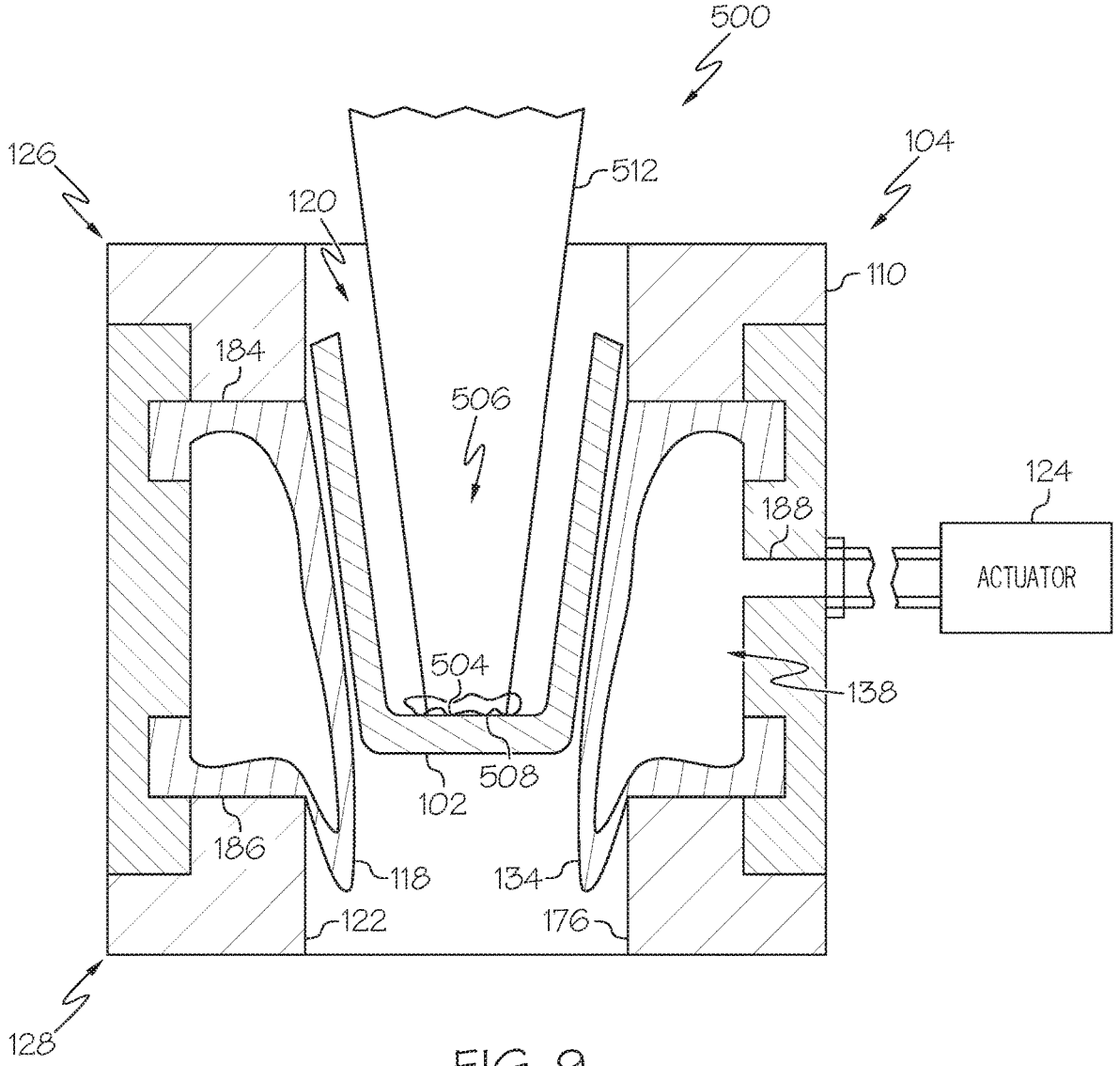
Figure 10:
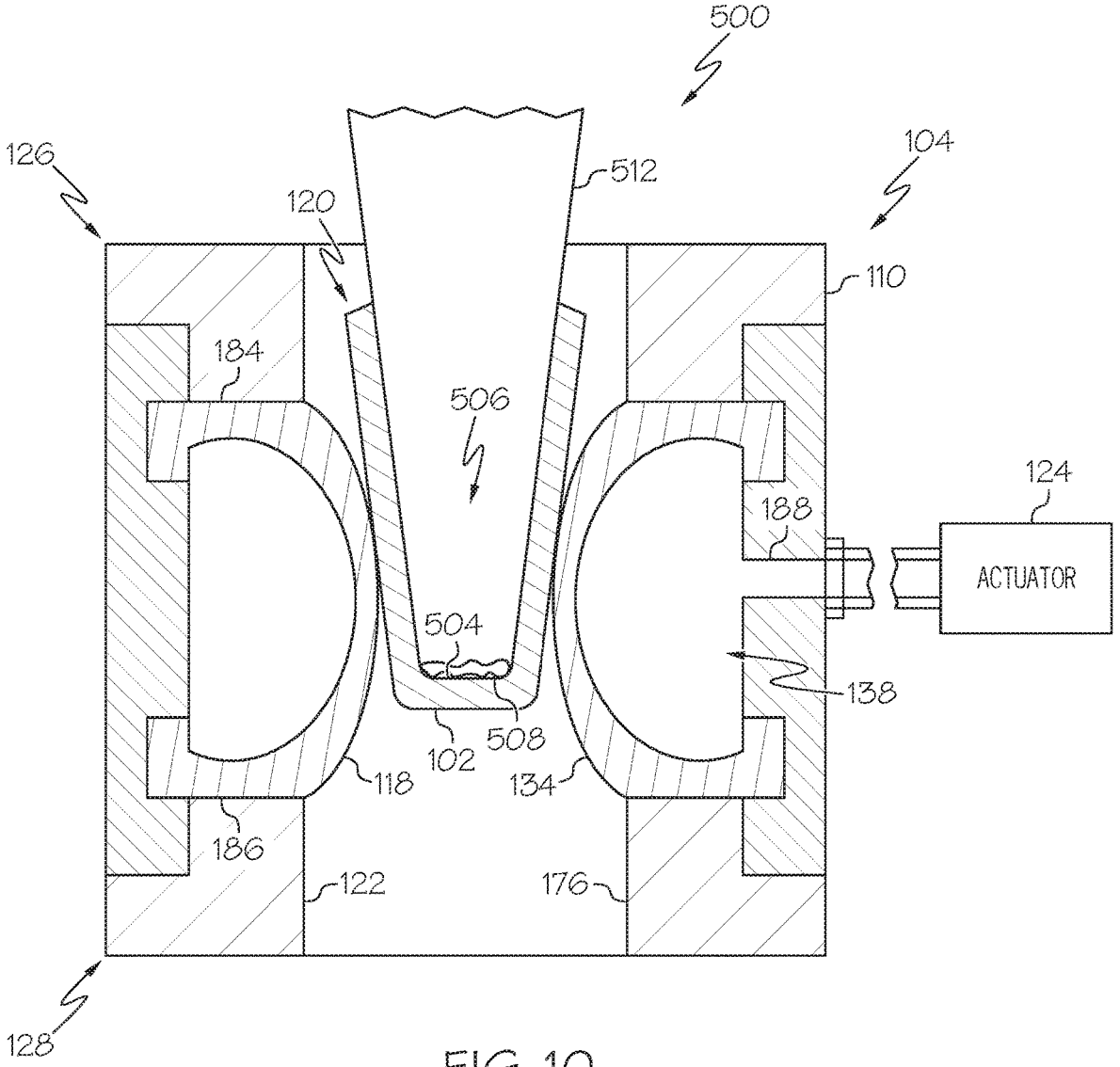

Referring generally to FIG. 1 and particularly to, e.g., FIGS. 9 and 10, constricting member 118 is inflatable into the closed position and is deflatable into the open position. The preceding subject matter of this paragraph characterizes example 9 of the present disclosure, wherein example 9 also includes the subject matter according to any one of examples 3 to 8, above.

Constricting member 118 being inflatable provides for active movement (e.g., inflating) into the closed position and passive, automating movement (e.g., deflating) back into the open position.

Referring to FIGS. 9 and 10, as an example, constricting member 118 that is inflatable is biased in the open position. Engagement of actuator 124 provides the driving force to inflate constricting member 118 into the closed position circumferentially around nozzle 500, with cleaning pad 102 adhered thereto. The driving force continues to maintain constricting member 118 inflated into the closed position until disengagement of actuator 124. Upon disengagement of actuator 124, constricting member 118 deflates and automatically returns to the open position.

Referring generally to FIG. 1 and particularly to, e.g., FIGS. 9 and 10, constricting member 118 comprises flexible bag 134. Flexible bag 134 is connected to housing 110. Actuator 124 forces air within interior 138 of flexible bag 134 to inflate flexible bag 134 into the closed position. The preceding subject matter of this paragraph characterizes example 10 of the present disclosure, wherein example 10 also includes the subject matter according to any one of examples 3 to 5, above.

Flexible bag 134 is biased in the open position and is capable of inflating or expanding into the closed position. Flexible bag 134 is inflated into the closed position upon application of a pneumatic force or positive pressure in response to air being forced into interior 138 of flexible bag 134 by engagement of actuator 124.

Referring to FIGS. 9 and 10, in an example, interior 138 is defined by a volume formed between flexible bag 134 and inner sidewall 176 of housing 110. Flexible bag 134 includes an annular first edge 184 connected to inner sidewall 176 and an opposed annular second edge 186 connected to inner sidewall 176. Flexible bag 134 spans across a portion of inner sidewall 176.

Referring still to FIGS. 9 and 10, in an example implementation, engagement of actuator 124 forces air into interior 138 to create a positive pressure (e.g., increase the pressure) between inner sidewall 176 and flexible bag 134. The increasing positive pressure expands the volume of interior 138 and forces flexible bag 134 into the closed position (e.g., inflates flexible bag 134 to partially enclose, or reduce the cross-sectional area of, channel 120) in order to circumferentially squeeze cleaning pad 102 around exterior 512 of nozzle 500, as best illustrated in FIG. 10. Disengagement of actuator 124 allows air to escape from within interior 138 to reduce the pressure between inner sidewall 176 and flexible bag 134. The reduced pressure allows flexible bag 134 to deflate and automatically return to its original, open position, as best illustrated in FIG. 9.

Referring generally to FIG. 1 and particularly to, e.g., FIGS. 11-14, actuator 124 moves constricting member 118 into the open position. The preceding subject matter of this paragraph characterizes example 11 of the present disclosure, wherein example 11 also includes the subject matter according to any one of examples 3 to 5, above.

Actuator 124 serves to provide a driving force to actively and in a controlled manner move constricting member 118 from the closed position back to the open position after cleaning pad 102 is circumferentially squeezed around exterior 512 of nozzle 500 and nozzle 500 is removed from constricting device 104.

Referring generally to FIG. 1 and particularly to, e.g., FIGS. 11 and 12, constricting member 118 is expandable into the closed position and is retractable into the open position. The preceding subject matter of this paragraph characterizes example 12 of the present disclosure, wherein example 12 also includes the subject matter according to example 11, above.

Constricting member 118 being expandable provides for active movement (e.g., expanding) into the closed position and active movement (e.g., retracting) back into the open position.

Referring to FIGS. 11 and 12, as an example, constricting member 118 that is expandable is controlled between the open position and the closed position. A first engagement of actuator 124 provides the driving force to expand constricting member 118 into the closed position circumferentially around nozzle 500, with cleaning pad 102 adhered thereto. Constricting member 118 maintains itself the closed position. A second engagement of actuator 124 provides a driving force to retract constricting member 118 back into the open position.

Referring generally to FIG. 1 and particularly to, e.g., FIGS. 11 and 12, constricting member 118 comprises bellows 136. Bellows 136 is connected to housing 110. Actuator 124 is configured to force air within interior 140 of bellows 136 to expand bellows 136 into the closed position. Actuator 124 is configured to withdraw the air from within interior 140 of bellows 136 to retract bellows 136 into the open position. The preceding subject matter of this paragraph characterizes example 13 of the present disclosure, wherein example 13 also includes the subject matter according to example 11 or 12, above.

Bellows 136 is capable of expanding into the closed position and retracting back into the open position. Bellows 136 is expanded into the closed position upon application of a pneumatic force or a positive pressure in response to air being forced into interior 140 of bellows 136 by first engagement of actuator 124. Bellows 136 is retracted back into the open position upon application of another pneumatic force or negative pressure in response to air being removed from interior 140 of bellows 136 by second engagement of actuator 124.

Referring to FIGS. 11 and 12, in an example, interior 140 is defined by an enclosed volume formed within annular body 190 of bellows 136. Annular body 190 of bellows 136 may include an annular first end 194 connected to inner sidewall 176 of housing 110. Annular body 190 also includes annular second end 196, located opposite to annular first end 194, forming at least a portion of periphery 122 of channel 120. When bellows 136 is expanded into the closed position, annular second end 196 of annular body 190 extends into channel 120. Annular body 190 of bellows 136 also includes sidewalls 198, extending between annular first end 194 and annular second end 196 and having a plurality of accordion pleats that allows bellows 136 to expand and retract between the closed and open positions, respectively.

Referring still to FIGS. 11 and 12, in an example, housing 110 includes annular recess 192 formed within inner sidewall 176. Bellows 136 is at least partially received within annular recess 192. As an example, when in the open position, annular second end 196 of bellows 136 is positioned proximate to inner sidewall 176 of housing 110 to define at least a portion of periphery 122 of channel 120.

Referring still to FIGS. 11 and 12, in an example implementation, first engagement of actuator 124 forces air into interior 140 of bellows 136 to create a positive pressure between annular first end 194 and annular second end 196 of annular body 190 of bellows 136. The increasing positive pressure expands the volume of interior 140 and forces bellows 136 into the closed position (e.g., expands sidewalls 198 of bellows 136 and pushes annular second end 196 away from annular first end 194 to partially enclose, or reduce the cross-sectional area of, channel 120) in order to circumferentially squeeze cleaning pad 102 around exterior 512 of nozzle 500, as best illustrated in FIG. 12. Second engagement of actuator 124 withdraws air from within interior 140 of bellows 136 to create a negative pressure between annular first end 194 and annular second end 196 of annular body 190 of bellows 136. The increasing negative pressure reduces the volume of interior 140 and forces bellows 136 into the open position (e.g., retracts sidewalls 198 of bellows 136 and pulls annular second end 196 toward annular first end 194), as best illustrated in FIG. 11.

Referring generally to FIG. 1 and particularly to, e.g., FIGS. 11-14, constricting member 118 is configured to reciprocate between the open position and the closed position. The preceding subject matter of this paragraph characterizes example 14 of the present disclosure, wherein example 14 also includes the subject matter according to any one of examples 11 to 13, above.

Constricting member 118 being reciprocating provides for controlled, active movement of constricting member alternating between the open position and the closed position.

Referring to FIGS. 13 and 14, as an example, constricting member 118 that is capable of reciprocating motion is controlled between the open position and the closed position. First engagement of actuator 124 provides the driving force to move constricting member 118 into the closed position circumferentially around nozzle 500, with cleaning pad 102 adhered thereto. Constricting member 118 maintains itself the closed position. Second engagement of actuator 124 provides a driving force to move constricting member 118 back into the open position.

Referring generally to FIG. 1 and particularly to, e.g., FIGS. 13 and 14, constricting member 118 comprises plurality of leaves 142. Plurality of leaves 142 is arranged in a circular pattern and is pivotally connected to housing 110. Actuator 124 is configured to simultaneously rotate plurality of leaves 142 into the closed position. Actuator 124 is configured to simultaneously counter-rotates plurality of leaves 142 into the open position. The preceding subject matter of this paragraph characterizes example 15 of the present disclosure, wherein example 15 also includes the subject matter according to example 11 or 14, above.

Plurality of leaves 142 is capable of pivoting inwardly into the closed position and alternately pivoting outwardly into the open position. Plurality of leaves 142 pivot inwardly into the closed position upon application of a mechanical force acting on plurality of leaves 142 by first engagement of actuator 124. Plurality of leaves 142 pivot outwardly into the open position upon application of another mechanical force acting on plurality of leaves 142 by second engagement of actuator 124.

Referring to FIGS. 13 and 14, in an example, each one of plurality of leaves 142 is pivotally connected to inner sidewall 176 of housing 110. Mechanical linkage assembly 200 interconnects plurality of leaves 142 with actuator 124. Mechanical linkage assembly 200 may have various structural and/or operational configurations without limitation. As an example, mechanical linkage assembly 200 may include a rotatable outer race and a plurality of links pivotally interconnecting each one of plurality of leaves 142 to the outer race. Rotation of the outer race in a first direction pivots each one of the plurality of links, which in turn pivots each one of plurality of leaves 142 radially inward relative to inner sidewall 176 of housing 110 into the closed position, as best illustrated in FIG. 14. Counter-rotation of the outer race in an opposing second direction pivots each one of the plurality of links, which in turn pivots each one of plurality of leaves 142 radially outward relative to inner sidewall 176 of housing 110 into the open position, as best illustrated in FIG. 13.

Referring still to FIGS. 13 and 14, in an example implementation, first engagement of actuator 124 translates a mechanical force through mechanical linkage assembly 200 to plurality of leaves 142. A first mechanical force rotates plurality of leaves 142 into the closed position (e.g., pivots each one of plurality of leaves 142 radially inward to partially enclose, or reduce the cross-sectional area of, channel 120) in order to circumferentially squeeze cleaning pad 102 around exterior 512 of nozzle 500. A second mechanical force counter-rotates plurality of leaves 142 into the open position (e.g., pivots each one of plurality of leaves 142 radially outward).

Referring generally to FIG. 1 and particularly to, e.g., FIGS. 7-12, actuator 124 comprises a pneumatic control valve actuator to produce a positive pressure to move constricting member 118 into the closed position. The preceding subject matter of this paragraph characterizes example 16 of the present disclosure, wherein example 16 also includes the subject matter according to any one of examples 11 to 14, above.

The pneumatic control valve actuator provides the pneumatic force, or the positive pressure, to actively move constricting member 118 into the closed position.

Referring to FIGS. 4 and 7-10, in an example, pneumatic control valve actuator is an electromechanical solenoid valve. Compressed-air source 202 (FIG. 4) is pneumatically coupled to actuator 124 (e.g., the pneumatic control valve actuator). Engagement (e.g., first engagement) of actuator 124, or actuation of the pneumatic control valve actuator, initiates a forced flow of compressed air to produce the positive pressure that moves constricting member 118 into the closed position. Disengagement of actuator 124 ceases the forced flow of compressed air that allows constricting member 118 to automatically return to the open position.

Referring to FIGS. 7 and 8, as an example, engagement or actuation of actuator 124 (e.g., the pneumatic control valve actuator) initiates the forced flow of compressed air into chamber 132 to stretch elastic membrane 130 into the closed position. Disengagement of actuator 124 (e.g., the pneumatic control valve actuator) ceases the forced flow of compressed air into chamber 132 and allows air to exit chamber 132 such that elastic membrane 130 springs back to the open position.

Referring to FIGS. 9 and 10, as an example, engagement or actuation of actuator 124 (e.g., the pneumatic control valve actuator) initiates the forced flow of compressed air into interior 138 of flexible bag 134 to inflate flexible bag 134 into the closed position. Disengagement of actuator 124 (e.g., the pneumatic control valve actuator) ceases the forced flow of compressed air into interior 138 of flexible bag 134 and allows air to exit interior 138 of flexible bag 134 such that flexible bag 134 deflates back to the open position.

Referring generally to FIG. 1 and particularly to, e.g., FIGS. 9-12, actuator 124 produces a negative pressure to move constricting member 118 into the open position. The preceding subject matter of this paragraph characterizes example 17 of the present disclosure, wherein example 17 also includes the subject matter according to example 16, above.

The pneumatic control valve actuator also provides the pneumatic force, or the negative pressure, to actively move constricting member 118 into the open position.

Referring to FIGS. 4 and 11-12, in an example, vacuum source 204 (FIG. 4) is pneumatically coupled to actuator 124 (e.g., the pneumatic control valve actuator). Engagement (e.g., second engagement) of actuator 124, or actuation of the pneumatic control valve actuator, initiates a forced withdrawal of air to produce the negative pressure that moves constricting member 118 from the closed position into the open position.

Referring to FIGS. 11 and 12, as an example, engagement or actuation of actuator 124 (e.g., the pneumatic control valve actuator) initiates the forced flow of compressed air into interior 140 of bellows 136 to expand bellows 136 into the closed position. Engagement or actuation of actuator 124 (e.g., the pneumatic control valve actuator) initiates a forced withdrawal of air from within interior 140 of bellows 136 to retract bellows 136 into the open position.

Referring to FIGS. 7-10, in an example, housing 110 of constricting device 104 includes at least one orifice 188 that extends through inner sidewall 176 and allows the forced flow of compressed air that acts upon constricting member 118 and moves constricting member 118 into the closed position upon engagement of actuator 124. As an example, orifice 188 extends through inner sidewall 176 of housing 110 and into chamber 132 to allow the forced flow of compressed air into chamber 132 and stretch elastic membrane 130 into the closed position, as illustrated in FIGS. 7 and 8. As another example, orifice 188 extends through inner sidewall 176 of housing 110 and into interior 138 of flexible bag 134 to allow the forced flow of compressed air into interior 138 of flexible bag 134 and inflate flexible bag 134 into the closed position, as illustrated in FIGS. 9 and 10.

Referring to FIGS. 11 and 12, depending upon the configuration of constricting member 118 and actuator 124, orifice 188 also allows the forced withdrawal of air that acts upon constricting member 118 and moves constricting member 118 into the open position upon engagement of actuator 124. As an example, orifice 188 extends through inner sidewall 176 of housing 110 and into interior 140 of bellows 136 to allow the forced flow of compressed air into interior 140 of bellows 136 and expand bellows 136 into the closed position, as illustrated in FIG. 8. Orifice 188 also allows the forced withdrawal of air from within interior 140 of bellows 136 and retracts bellows 136 into the open position, as illustrated in FIG. 7.

Referring generally to FIG. 1 and particularly to, e.g., FIGS. 13 and 14, actuator 124 comprises one of a mechanical actuator or a pneumatic actuator to produce one of linear motion or rotary motion to move constricting member 118 between the open position and the closed position. The preceding subject matter of this paragraph characterizes example 18 of the present disclosure, wherein example 18 also includes the subject matter according to example 11 or 15, above.

The mechanical actuator produces one of linear motion or rotary motion that provides the driving force to alternately move (e.g., reciprocate) constricting member 118 between the open position and the closed position. The pneumatic actuator produces one of linear motion or rotary motion that provides the driving force to alternately move (e.g., reciprocate) constricting member 118 between the open position and the closed position.

Referring to FIGS. 13 and 14, engagement (e.g., first engagement) of actuator 124, or linear or rotary motion of the mechanical actuator or pneumatic actuator in a first direction, is translated into movement of constricting member 118 into the closed position. Engagement (e.g., second engagement) of actuator 124, or linear or rotary motion of the mechanical actuator or pneumatic actuator in an opposed second direction, is translated into movement of constricting member 118 into the open position.

Referring still to FIGS. 13 and 14, in an example, mechanical actuator is a linear mechanical actuator. Engagement (e.g., first engagement), or linear motion, of the linear mechanical actuator in the first direction, pivots plurality of leaves 142 into the closed position. Engagement (e.g., second engagement), or linear motion, of the linear mechanical actuator in the second direction, pivots plurality of leaves 142 into the open position. As an example, linear motion of the linear mechanical actuator is translated to plurality of leaves 42 via mechanical linkage assembly 200.

Referring still to FIGS. 13 and 14, in another example, mechanical actuator is a rotary mechanical actuator. Engagement (e.g., first engagement), or rotary motion, of the rotary mechanical actuator in the first direction, pivots plurality of leaves 142 into the closed position. Engagement (e.g., second engagement), or rotary motion, of the rotary mechanical actuator in the second direction, pivots plurality of leaves 142 into the open position. As an example, rotary motion of the rotary mechanical actuator is translated to plurality of leaves 42 via mechanical linkage assembly 200.

Referring still to FIGS. 13 and 14, in an example, pneumatic actuator is a linear pneumatic actuator. Engagement (e.g., first engagement), or linear motion, of the linear pneumatic actuator in the first direction, pivots plurality of leaves 142 into the closed position. Engagement (e.g., second engagement), or linear motion, of the linear pneumatic actuator in the second direction, pivots plurality of leaves 142 into the open position. As an example, linear motion of the linear pneumatic actuator is translated to plurality of leaves 42 via mechanical linkage assembly 200.

Referring still to FIGS. 13 and 14, in another example, pneumatic actuator is a rotary pneumatic actuator. Engagement (e.g., first engagement), or rotary motion, of the rotary pneumatic actuator in the first direction, pivots plurality of leaves 142 into the closed position. Engagement (e.g., second engagement), or rotary motion, of the rotary pneumatic actuator in the second direction, pivots plurality of leaves 142 into the open position. As an example, rotary motion of the rotary pneumatic actuator is translated to plurality of leaves 42 via mechanical linkage assembly 200.

Referring generally to FIG. 1 and particularly to, e.g., FIGS. 2-4, apparatus 100 further comprises comprising air amplifier 146 in fluid communication with channel 120 of constricting device 104. Air amplifier 146 is configured to withdraw one of at least one cleaning pad 102 from within channel 120 and to eject one of at least one cleaning pad 102 into disposal receptacle 106. The preceding subject matter of this paragraph characterizes example 19 of the present disclosure, wherein example 19 also includes the subject matter according to any one of examples 2 to 18, above.

Air amplifier 146 actively removes used cleaning pad 107 from within channel 120 of housing 110 of constricting device 104 and transfers used cleaning pad 107 into disposal receptacle 106 following circumferential squeezing of cleaning pad 102 around nozzle 500 and removal of nozzle 500 from constricting device 104.

Referring to FIGS. 2-4, in an example, air amplifier 146 is coupled to support base 170 opposite constricting device 104. As an example, air amplifier 146 is connected to support surface 172 opposite housing 110 of constricting device 104, aligned with channel 120 of constricting device 104 and pass-through opening 174 (FIG. 3) of support surface 172 and positioned over disposal receptacle 106. Air amplifier 146 is in fluid communication with channel 120 of constricting device 104. As an example, an inlet of air amplifier 146 is positioned proximate to second end 128 of housing 110. During operation, compressed air flows through an inlet formed through air amplifier 146 and into an annular chamber. The compressed air is then throttled through a small ring nozzle at high velocity and is directed toward an outlet end of air amplifier 146. A low pressure is created around a center of the inlet end of air amplifier that induces a high volume flow of surrounding air into a primary air stream flowing through air amplifier. The low pressure at the inlet end of air amplifier 146 pulls used cleaning pad 102 from within channel 120 and primary air stream carries used cleaning pad 107 through air amplifier 146 and into disposal receptacle 106. In an example, compressed-air source 202 (FIG. 3) is pneumatically coupled to air amplifier 146 to provide the compressed air that flows through air amplifier 146.

In an example, air amplifier 146 is a forced airflow booster commercially available from a variety of sources.

Referring generally to FIG. 1 and particularly to, e.g., FIGS. 2-4, apparatus 100 dispenser 108 further comprises linear actuator 148. Linear actuator 148 is connected to platform 114 to linearly move at least one cleaning pad 102, supported on platform 114, into contact with nozzle 500. The preceding subject matter of this paragraph characterizes example 20 of the present disclosure, wherein example 20 also includes the subject matter according to any one of examples 1 to 19, above.

Linear actuator 148 provides controlled linear motion of platform 114 to move cleaning pad 102 into contact with tip 504 of nozzle 500.

Figure 5:
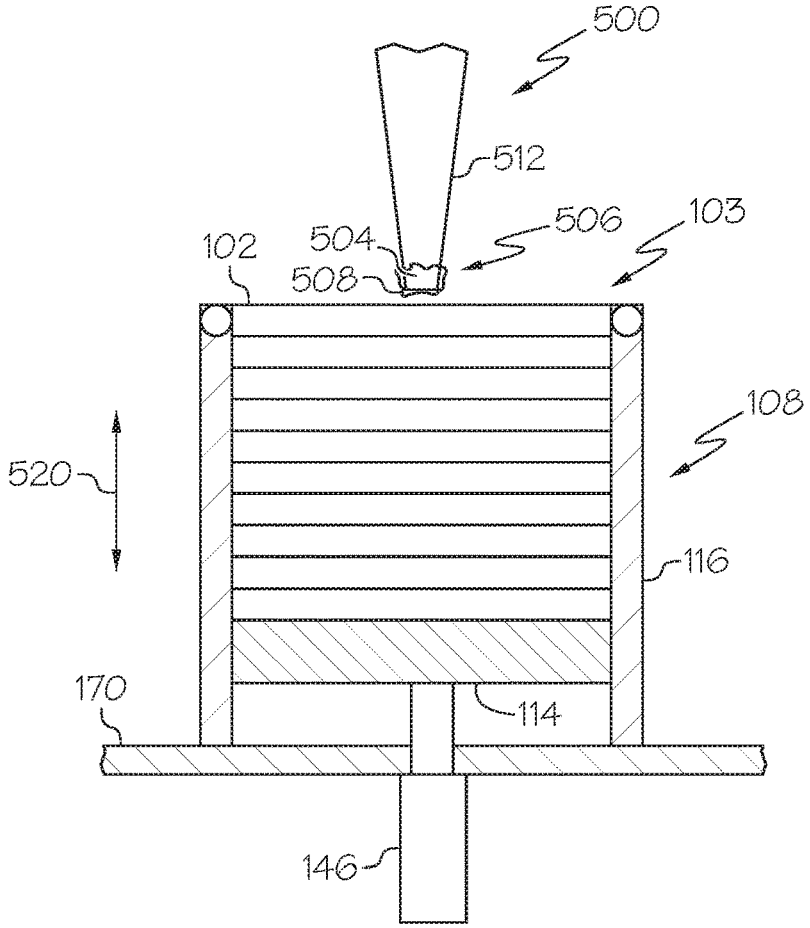
Figure 6:
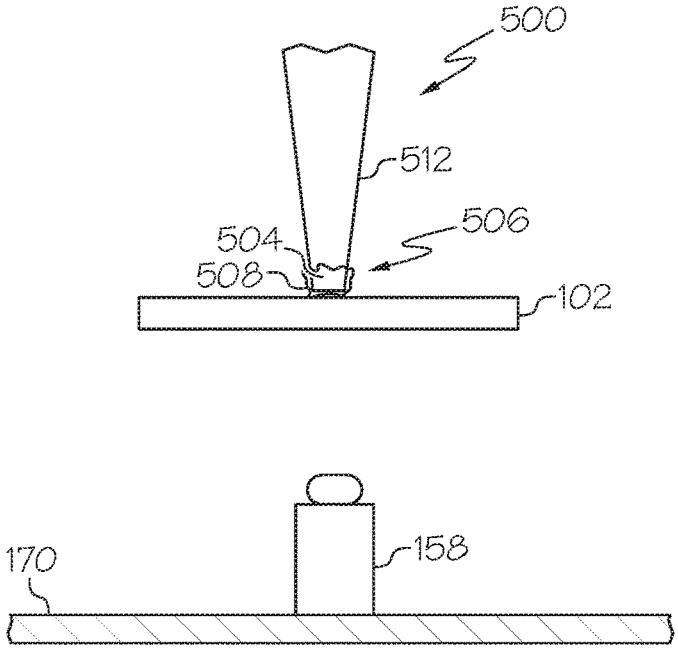

Referring to FIGS. 2-5, in an example, linear actuator 148 is coupled to support base 170. As an example, linear actuator 148 is connected to support surface 172 opposite cage 116. At least a movable portion of linear actuator 148 passes through support surface 172 and is connected to platform 114. Engagement, or actuation, of linear actuator 148 reciprocatingly extends and retracts the movable portion of linear actuator 148 and causes platform 114 to move, for example, upwardly and downwardly, relative to support surface 172. As an example, in a fully retracted position of linear actuator 148, platform 114 and at least one cleaning pad 102 (e.g., the stack of cleaning pads) supported on platform 114 are positioned in an initial position, as best illustrated in FIG. 2. Extension of linear actuator 148 moves platform 114 position at least one cleaning pad 102, supported on platform 114, into contact with tip 504 of nozzle 500, as best illustrated in FIG. 5.

Referring generally to FIG. 1 and particularly to, e.g., FIGS. 2-4, linear actuator 148 comprises a pneumatic cylinder. The preceding subject matter of this paragraph characterizes example 21 of the present disclosure, wherein example 21 also includes the subject matter according to example 20, above.

The pneumatic cylinder provides controlled linear motion of platform 114 to move cleaning pad 102 into contact with tip 504 of nozzle 500. Use of the pneumatic cylinder as linear actuator 148 allows compressed-air source 202 to be used to extend and retract the pneumatic cylinder.

Referring to FIGS. 2 and 3, in an example, the pneumatic cylinder is a double-action air cylinder. As an example, compressed-air source 202 is pneumatically connected to the pneumatic cylinder to extend and retract the pneumatic cylinder in response to application of a forced flow of compressed air from compressed-air source 202.

In another example, linear actuator 148 may be a mechanical linear actuator.

Referring generally to FIG. 1 and particularly to, e.g., FIGS. 2 and 3, dispenser 108 further comprises at least one position sensor 150 to determine at least one position of platform 114. The preceding subject matter of this paragraph characterizes example 22 of the present disclosure, wherein example 22 also includes the subject matter according to any one of examples 1 to 21, above.

At least one position sensor 150 provides a means to determine a position of platform 114, for example, relative to nozzle 500, based on linear movement of linear actuator 148.

In an example, at least one position sensor 150 is configured to determine the position of platform 114 based on the extended and/or retracted positions of linear actuator 148 through the stroke of linear actuator 148. As an example, at least one sensor 150 is an electrical switch operated by an applied magnetic field. For example, at least one sensor 150 is a magnetic sensor that is actuated by one or more magnets integrated with linear actuator 148. As a specific, non-limiting example, at least one position sensor 150 is a reed switch.

In an example implementation, at least one position sensor 150 is actuated each time linear actuator 148 is extended and/or retracted through its stroke. At least one position sensor 150 may provide a safety function by ensuring linear actuator 148 is in its fully retracted position before actuation of linear actuator 148. In addition to determining the position of platform 114, at least one position sensor 150 may be used as part of a counting function, as will be described in greater detail below.

Referring generally to FIG. 1 and particularly to, e.g., FIG. 3, dispenser 108 further comprises first position sensor 152 to determine whether platform 114 is located at a fully retracted position. The preceding subject matter of this paragraph characterizes example 23 of the present disclosure, wherein example 23 also includes the subject matter according to any one of examples 1 to 22, above.

First position sensor 152 provides a safety function to ensure linear actuator 148 is in its fully retracted position before actuation of linear actuator 148.

Referring to FIG. 3, in an example, first position sensor 152 is located proximate to linear actuator 148 at a position suitable to determine whether linear actuator 148 is in its fully retracted position indicating that platform 114 and cleaning pad 102 supported on platform 114 are in the initial position prior to being moved into contact with tip 504 of nozzle 500. First position sensor 152 is an example of one of at least one position sensor 150.

In an example implementation, when linear actuator 148 is in its fully retracted position, first position sensor 152 is actuated. Actuation of first position sensor 152 indicates that linear actuator 148 is prepared for actuation, for example, by application of compressed air, to move platform 114 and cleaning pad 102 supported on platform 114 into contact with tip 504 of nozzle 500.

Referring generally to FIG. 1 and particularly to, e.g., FIG. 3, dispenser 108 further comprises second position sensor 154 to determine whether platform 114 is located at a fully extended position. The preceding subject matter of this paragraph characterizes example 24 of the present disclosure, wherein example 24 also includes the subject matter according to any one of examples 1 to 23, above.

Second position sensor 154 provides a cleaning pad consumption function by determining when linear actuator 148 is in its fully extended position when moving platform 114 and cleaning pad 102 into contact with nozzle 500.

Referring to FIG. 3, in an example, second position sensor 154 is located proximate to linear actuator 148 at a position suitable to determine whether linear actuator 148 is in its fully extended position indicating that platform 114 and cleaning pad 102 supported on platform 114 are in maximum allowed contact position when moved into contact with tip 504 of nozzle 500. Second position sensor 154 is an example of one of at least one position sensor 150.

In an example implementation, when linear actuator 148 reaches its fully extended position, second position sensor 154 is actuated. Actuation of second position sensor 154 indicates that the original number of cleaning pads 102 supported on platform 114 has been consumed.

Referring generally to FIG. 1 and particularly to, e.g., FIG. 3, dispenser 108 further comprises third position sensor 156 to determine whether platform 114 is located between a fully retracted position and a fully extended position. The preceding subject matter of this paragraph characterizes example 25 of the present disclosure, wherein example 25 also includes the subject matter according to any one of examples 1 to 24, above.

Third position sensor 156 provides one of a counting function by determining when linear actuator 148 has transitioned between the retracted position and the extended position when moving platform 114 and cleaning pad 102 into contact with nozzle 500 and/or a safety function to ensure linear actuator 148 is in its fully retracted position before actuation of linear actuator 148.

Referring to FIG. 3, in an example, third position sensor 156 is located proximate to linear actuator 148 at a position suitable to determine whether linear actuator 148 is between its fully retracted position and its fully extended position. Third position sensor 156 is an example of one of at least one position sensor 150.

In an example implementation, when linear actuator 148 is between its fully retracted position and its fully extended position, third position sensor 156 is actuated. Actuation of third position sensor 156 indicates that linear actuator 148 is not prepared for actuation and needs to be retracted into its fully retracted position. Optionally, each time linear actuator 148 transitions from its fully retracted position to its fully extended position, third position sensor 156 is actuated. Actuation of third position sensor 156 may be used as a cleaning pad counter to determine the number of cleaning pads that has been consumed.

Referring generally to FIG. 1 and particularly to, e.g., FIGS. 2-4 and 6, apparatus 100 further comprises pad sensor 158. Pad sensor 158 is positioned to determine whether at least one cleaning pad 102 is adhered to nozzle 500. The preceding subject matter of this paragraph characterizes example 26 of the present disclosure, wherein example 26 also includes the subject matter according to any one of examples 1 to 25, above.

Pad sensor 158 provides a means to ensure that cleaning pad 102 is adhered to tip 504 of nozzle 500 before nozzle 500, with cleaning pad 102 adhered thereto, is inserted into constricting device 104.

Referring to FIGS. 2-4 and 6, in an example, pad sensor 158 is coupled to support base 170. As an example, pad sensor 158 is connected to support surface 172 proximate to at least one of dispenser 108 and/or constricting device 104. As an example, pad sensor 158 is positioned along a path of nozzle 500 between dispenser 108, after picking up cleaning pad 102 from platform 114, and constricting device 104. In an example, pad sensor 158 is a non-contact sensor. For example, pad sensor 158 may determine whether cleaning pad 102 is adhered to tip 504 of nozzle 500 without making contact with cleaning pad 102 or nozzle 500. In another example, pad sensor 158 is a contact sensor. For example, pad sensor 158 may determine whether cleaning pad 102 is adhered to tip 504 of nozzle 500 by making contact with cleaning pad 102 or nozzle 500.

Referring still to FIGS. 2-4 and 6, in an example implementation, after tip 504 of nozzle 500 makes contact with cleaning pad 102 and adhesively picks up and removes cleaning pad 102 from platform 114, nozzle 500 interacts with pad sensor 158 to determine whether cleaning pad 102 is adhered to nozzle 500.

Referring generally to FIG. 1 and particularly to, e.g., FIGS. 2-4 and 6, pad sensor 158 comprises an electro-optical sensor. The preceding subject matter of this paragraph characterizes example 27 of the present disclosure, wherein example 27 also includes the subject matter according to example 26, above.

Use of the electro-optical sensor as pad sensor 158 allows for determining whether cleaning pad 102 is coupled (e.g., adhered) to nozzle 500 without making contact with cleaning pad 102 or nozzle 500.

In an example, the electro-optical sensor is a photoelectric sensor commercially available from a variety of sources.

Referring generally to FIG. 1 and particularly to, e.g., FIG. 4, apparatus 100 further comprises electronic controller 160 to control actuation of constricting device 104 based on a first position of nozzle 500. The preceding subject matter of this paragraph characterizes example 28 of the present disclosure, wherein example 28 also includes the subject matter according to any one of examples 1 to 27, above.

Electronic controller 160 provides logic controls for actuation of constricting device 104 to circumferentially squeeze one cleaning pad 102, adhesively picked up from platform 114 by nozzle 500, around nozzle 500 once nozzle 500 is inserted into constricting device 104.

Referring to FIG. 4, in an example, electronic controller 160 is a programmable logic controller (PLC), or other programmable controller. Electronic controller 160 is operatively coupled to constricting device 104 to control movement (e.g., actuation) of constricting member 118 into the closed position and, optionally, depending upon the configuration of constricting device 104, into the open position. As an example, electronic controller 160 is operatively coupled to actuator 124. Operation of electronic controller 160 is based on one or more electronic (e.g., analog or digital) input signals provided to electronic controller 160 from one or more input sources. Operation of constricting device 104 is based on one or more electronic output signals generated by electronic controller 160.

Referring generally to FIG. 1 and particularly to, e.g., FIG. 4, electronic controller 160 controls movement of platform 114 based on a second position of nozzle 500. The preceding subject matter of this paragraph characterizes example 29 of the present disclosure, wherein example 29 also includes the subject matter according to example 28, above.

Electronic controller 160 provides logic controls for movement of platform 114 to engage cleaning pad 102 with tip 504 of nozzle 500.

Referring to FIG. 4, in an example, electronic controller 160 is operatively coupled to linear actuator 148 to move platform 114. Operation of electronic controller 160 is based on one or more input signals provided to electronic controller 160 from one or more electronic input sources. Operation of linear actuator 148 is based on one or more electronic output signals generated by electronic controller 160.

Referring generally to FIG. 1 and particularly to, e.g., FIG. 4, apparatus 100 further comprises pneumatic controller 162. Pneumatic controller 162 is operatively coupled to constricting device 104. The preceding subject matter of this paragraph characterizes example 30 of the present disclosure, wherein example 30 also includes the subject matter according to any one of examples 1 to 29, above.

Pneumatic controller 162 provides the means for actuation of constricting device 104 to circumferentially squeeze one cleaning pad 102, adhesively picked up from platform 114 by nozzle 500, around nozzle 500 once nozzle 500 is inserted into constricting device 104. controls application of the forced flow of air to move constricting member 118

Referring to FIG. 4, in an example, pneumatic controller 162 includes a plurality, or stack, of pneumatic control valve actuators. As an example, each one of the plurality of pneumatic control valve actuators is a solenoid valve. Pneumatic controller 162 is operatively coupled to constricting device 104 to move (e.g., actuate) constricting member 118 into the closed position and, optionally, depending upon the configuration of constricting device 104, into the open position. As an example, one or more of the plurality of pneumatic control valve actuators is operatively (e.g., pneumatically) coupled to constricting device 104. In an example, actuator 124 is one or more of the pneumatic control valve actuators of pneumatic controller 162. Pneumatic controller 162 controls application of the forced flow of air to move constricting member 118. As an example, pneumatic controller 162 controls application of the forced flow of compressed air that generates the positive pressure to move constricting member 118 into the closed position. As another example, pneumatic controller 162 controls application of the forced flow of air that generates the negative pressure to move constricting member 118 into the open position.

Referring still to FIG. 4, in an example, electronic controller 160 is operatively (e.g., electronically) coupled to pneumatic controller 162. Operation of pneumatic controller 162 is based on one or more electronic input signals provided to pneumatic controller 162 from electronic controller 160. Operation of constricting device 104 is based on one or more pneumatic signals (e.g., forced air flow) provided to constricting device 104 by pneumatic controller 162.

In various examples, apparatus 100, as disclosed herein, may include various pneumatic components including, but not limited to, pneumatic tubing, fittings, etc., that interconnect compressed-air source 202, vacuum source 204, pneumatic controller 162, actuator 124, constricting device 104, air amplifier 146 and/or linear actuator 148.

Referring generally to FIG. 1 and particularly to, e.g., FIG. 4, pneumatic controller 162 is operatively coupled to platform 114. The preceding subject matter of this paragraph characterizes example 31 of the present disclosure, wherein example 31 also includes the subject matter according to example 30, above.

Pneumatic controller 162 provides the means for movement of platform 114 to engage cleaning pad 102 with tip 504 of nozzle 500.

Referring to FIG. 4, in an example, pneumatic controller 162 is operatively coupled to linear actuator 148 to move platform 114. As an example, one or more of the plurality of pneumatic control valve actuators is operatively (e.g., pneumatically) coupled to linear actuator 148. Pneumatic controller 162 controls application of the forced flow of air to actuate linear actuator 148 between the fully retracted position and the fully extended position and move platform 114 to position cleaning pad 102 into contact with tip 504 of nozzle 500.

Referring still to FIG. 4, in an example, operation of pneumatic controller 162 is based on one or more electronic input signals provided to pneumatic controller 162 by electronic controller 160. Operation of linear actuator 148 is based on one or more pneumatic signals provided to linear actuator 148 by pneumatic controller 162.

Referring generally to, e.g., FIGS. 1-14 and particularly to FIGS. 15A and 15B, method 1000 for removing residue 508 of substance 510, extrudable through nozzle 500 of automated end-effector 502, from exterior 512 of nozzle 500 is disclosed. Method 1000 comprises (block 1002) establishing contact between nozzle 500 and cleaning pad 102. Method 1000 also comprises (block 1004) adhering cleaning pad 102 to nozzle 500. Method 1000 further comprises (block 1006) inserting nozzle 500, with cleaning pad 102 adhered thereto, into constricting device 104. Method 1000 additionally comprises (block 1008) circumferentially squeezing cleaning pad 102 around nozzle 500 with constricting device 104. Method 1000 further comprises (block 1010) withdrawing nozzle 500 from constricting device 104 to separate cleaning pad 102 from nozzle 500 and remove residue 508 of substance 510 from exterior 512 of nozzle 500. Method 1000 also comprises (block 1012) transferring cleaning pad 102 from constricting device 104 to disposal receptacle 106. The preceding subject matter of this paragraph characterizes example 32 of the present disclosure.

Method 1000, as set forth above, provides for automated cleaning of residue 508 of substance 510 from exterior 512 of nozzle 500. Automated cleaning of residue 508 from nozzle 500 reduces, or eliminates, interruption of an automated process of application of substance 510 using automated end-effector 502.

Referring generally to FIGS. 1-14 and particularly to FIGS. 7-12, in an example implementation, nozzle 500 is positioned in the first position (FIGS. 7-12), for example, by moving automated end-effector 502 (FIG. 1) with the robotic arm. As an example, the first position of nozzle 500 is a position of nozzle 500 in three-dimensional space that positions at least a portion of nozzle 500, proximate end 506 of nozzle 500, within channel 120 of housing 110 of constricting device 104 and within constricting member 118. The first position of nozzle 500 may be based on a preprogrammed coordinate position of automated end-effector 502 as controlled by movement of the robotic arm.

Referring to FIGS. 1, 4 and 7-12, in an example implementation, when nozzle 500 is positioned in the first position, an input signal is transmitted to electronic controller 160, for example, provided by the programmable controller of the robotic arm. Upon receipt of the input signal, electronic controller 160 generates an output signal and transmits the output signal to pneumatic controller 162, instructing one or more of the plurality of pneumatic control valve actuators (e.g., actuator 124) to initiate a forced flow of compressed air to actuator 124, for example, from compressed-air source 202, in order to move constricting member 118 into the closed position. Insertion of nozzle 500 into channel 120 of constricting device 104 positions cleaning pad 102 between constricting member 118 and exterior 512 of nozzle 500. Movement of constricting member 118 into the closed position circumferentially squeezes cleaning pad 102 around exterior 512 of nozzle 500. With constricting member 118 in the closed position and cleaning pad 102 circumferentially squeezed around nozzle 500, nozzle 500 is then withdrawn from constricting member 118 and removed from constricting device 104 such that cleaning pad 102 removes residue 508 from exterior 512 and/or tip 504 of nozzle 500.

Referring to FIGS. 1, 4 and 7-10, in an example implementation, following removal of nozzle 500 from within constricting device 104, an input signal is transmitted to electronic controller 160, for example, provided by the programmable controller of the robotic arm. Upon receipt of the input signal, electronic controller 160 generates an output signal and transmits the output signal to pneumatic controller 162, instructing one or more of the plurality of pneumatic control valve actuators (e.g., actuator 124) to cease the forced flow of compressed air to actuator 124 in order to allow constricting member 118 to automatically return to the open position.

Referring to FIGS. 1, 4 and 11-14, in another example implementation, following removal of nozzle 500 from within constricting device 104, an input signal is transmitted to electronic controller 160, for example, provided by the programmable controller of the robotic arm. Upon receipt of the input signal, electronic controller 160 generates an output signal and transmits the output signal to pneumatic controller 162, instructing one or more of the plurality of pneumatic control valve actuators (e.g., actuator 124) to initiate a forced withdrawal of air, for example, from vacuum source 204, in order to move constricting member 118 back to the open position.

Referring to FIGS. 1-4 and 7-14, in an example implementation, after constricting member 118 has returned to the open position, air amplifier 146 transfers used cleaning pad 107 from within channel 120 to disposal receptacle 106. As an example, following removal of nozzle 500 and return of constricting member 118 to the open position, an input signal is transmitted to electronic controller 160. Upon receipt of the input signal, electronic controller 160 generates an output signal and transmits the output signal to pneumatic controller 162, instructing one or more of the plurality of pneumatic control valve actuators, pneumatically coupled to air amplifier 146, to initiate a forced flow of compressed air, for example, from compressed-air source 202, to air amplifier 146 in order to transfer used cleaning pad 107 from channel 120 into disposal receptacle 106.

Referring generally to, e.g., FIGS. 1-6 and particularly to FIGS. 15A and 15B, method 1000 further comprises (block 1014) positioning nozzle 500 over cleaning pad 102. Method 1000 also comprises (block 1016) linearly moving cleaning pad 102 to engage nozzle 500. The preceding subject matter of this paragraph characterizes example 33 of the present disclosure, wherein example 33 also includes the subject matter according to example 32, above.

Positioning nozzle 500 initiates movement of cleaning pad 102. Moving cleaning pad 102 positions cleaning pad 102 into contact with tip 504 of nozzle 500 to adhere one cleaning pad 102 to nozzle 500.

Referring generally to FIGS. 1-14 and particularly to FIG. 5, in an example implementation, prior to insertion of nozzle 500, with cleaning pad 102 adhered thereto, into constricting device 104, nozzle 500 is positioned in the second position (FIG. 5), for example, by moving automated end-effector 502 (FIG. 1) with the robotic arm. As an example, the second position of nozzle 500 is a position of nozzle 500 in three-dimensional space that positions tip 504 of nozzle 500 over the stack of at least one cleaning pad 102. The second position of nozzle 500 may be based on a pre-programmed coordinate position of automated end-effector 502 as controlled by movement of the robotic arm.

Referring to FIGS. 1, 4 and 5, in an example implementation, when nozzle 500 is positioned in the second position, an input signal is transmitted to electronic controller 160, for example, provided by a programmable controller of the robotic arm. Upon receipt of the input signal, electronic controller 160 generates an output signal and transmits the output signal to pneumatic controller 162, instructing one or more of the plurality of pneumatic control valve actuators to initiate a forced flow of compressed air to linear actuator 148 for example, from compressed-air source 202, in order to actuate linear actuator 148 and move platform 114, and cleaning pad 102 supported on platform 114, toward nozzle 500 (e.g., in the direction of directional arrow 520). Movement of platform 114 places cleaning pad 102 into contact with tip 504 of nozzle 500. Residue 508 of substance 510 adheres cleaning pad 102 to nozzle 500.

Referring generally to, e.g., FIGS. 1-6 and particularly to FIGS. 15A and 15B, method 1000 further comprises (block 1018) determining a position of cleaning pad 102 relative to nozzle 500 prior to linearly moving cleaning pad 102 to engage nozzle 500. The preceding subject matter of this paragraph characterizes example 34 of the present disclosure, wherein example 34 also includes the subject matter according to example 33, above.

Determining the position of cleaning pad 102 prior to linear movement of cleaning pad 102 functions as at least one of a safety feature, a counting feature and/or a cleaning pad consumption feature.

Referring to FIGS. 1-4, in an example implementation, at least one position sensor 150 determines a linear position of linear actuator 148 at one or more positions along its stroke to determine the position of cleaning pad 102 relative to nozzle 500.

Referring to FIGS. 1-5, in an example implementation, when linear actuator 148 is in its fully retracted position, first position sensor 152 is actuated indicating that platform 114, and at least one cleaning pad 102 supported on platform 114, are in the initial position and that it is safe to initiate movement of platform 114. Actuation of first position sensor 152 generates an input signal to electronic controller 160 indicating linear actuator 148 is in condition for application of the forced flow of compressed air to move platform 114 into the contact position to engage cleaning pad 102 with tip 504 of nozzle 500. As an example, positioning of nozzle 500 in the second position and actuation of first position sensor 152 generate input signals provided to electronic controller 160. Upon receipt of these input signals, electronic controller 160 generates an output signal and transmits the output signal to pneumatic controller 162, instructing one or more of the plurality of pneumatic control valve actuators to initiate a forced flow of compressed air to linear actuator 148 in order to actuate linear actuator 148 and move platform 114 into the contact position and engage cleaning pad 102 with tip 504 of nozzle 500.

Referring to FIGS. 1-4, in an example implementation, when linear actuator 148 is in its fully extended position, second position sensor 154 is actuated indicating that the plurality of cleaning pads initially supported on platform 114 has been consumed. Prior to consumption of the plurality of cleaning pads supported on platform 114, contact of the topmost one cleaning pad 102 of the stack of cleaning pads with tip 504 of nozzle 500 prevents full extension of linear actuator 148. Actuation of second position sensor 154 generates an input signal to electronic controller 160 indicating linear actuator 148 has reached its fully extended position and, thus, additional cleaning pads are needed. Upon receipt of this input signal, electronic controller 160 generates an output signal that provides an alert that the plurality of cleaning pads supported on platform 114 has been consumed.

Referring to FIGS. 1-4, in an example implementation, when linear actuator 148 transitions from the fully retracted position or between the fully retracted position and the fully extending position, third position sensor 156 is actuated. As an example, each time linear actuator 148 moves at least partially through its stroke, third position sensor 156 is actuated and generates an input signal to electronic controller 160. Electronic controller 160 may maintain a running tally of these sequential inputs, which are used to count the number of cleaning pads removed from platform 114 by nozzle 500. As another example, when linear actuator 148 is between its fully retracted position and fully extended position, third position sensor 156 is actuated indicating that platform 114, and at least one cleaning pad 102 supported on platform 114, are not the initial position and that it is not safe to initiate movement of platform 114. Actuation of third position sensor 156 generates an input signal to electronic controller 160 indicating linear actuator 148 is not in condition for application of the forced flow of compressed air to move platform 114 into the contact position to engage cleaning pad 102 with tip 504 of nozzle 500. As an example, positioning of nozzle 500 in the second position and actuation of third position sensor 156 generate input signals provided to electronic controller 160. Upon receipt of these input signals, electronic controller 160 generates an output signal and transmits the output signal to pneumatic controller 162, instructing one or more of the plurality of pneumatic control valve actuators to initiate a forced flow of compressed air to linear actuator 148 in order to return linear actuator 148 to its fully retraced position and move platform 114 into the initial position.

Referring generally to, e.g., FIGS. 1-6 and particularly to FIGS. 15A and 15B, method 1000 further comprises (block 1020) detecting whether cleaning pad 102 is adhered to nozzle 500. Method 1000 also comprises (block 1022)

reestablishing contact between nozzle 500 and cleaning pad 102 when cleaning pad 102 is not detected. The preceding subject matter of this paragraph characterizes example 35 of the present disclosure, wherein example 35 also includes the subject matter according to example 32 or 33, above.

Detecting whether cleaning pad 102 is adhered to nozzle 500 prevents nozzle 500, with residue 508 disposed on exterior 512 of nozzle 500, from being circumferentially squeezed by constricting device 104 without cleaning pad 102.

Referring to FIGS. 1-4 and 6, in an example implementation, after nozzle 500 is moved into the second position (FIG. 5) and platform 114 has been moved to engage cleaning pad 102 into contact with nozzle 500, nozzle 500 is moved into a third position (FIG. 6), for example, by moving automated end-effector 502 (FIG. 1) with the robotic arm. As an example, the third position of nozzle 500 is a position of nozzle 500 in three-dimensional space that positions nozzle 500, and cleaning pad 102 adhered to nozzle 500, where pad sensor 158 can detect whether or not cleaning pad 102 is adhered to nozzle 500. The third position of nozzle 500 may be based on a pre-programmed coordinate position of automated end-effector 502 as controlled by movement of the robotic arm.

In an example implementation, when nozzle 500 is positioned in the third position, pad sensor 158 detects cleaning pad 102. As an example, pad sensor 158 is a non-contact sensor, for example, that utilizes light or an interruption of light, to determine whether cleaning pad 102 is adhered to nozzle 500. In an example implementation, upon pad sensor 158 detecting cleaning pad 102, an input signal is transmitted to electronic controller 160. Upon receipt of this input signal, electronic controller 160 generates an output signal and transmits the output signal to the programmable controller of the robotic arm, instructing the robotic arm to move nozzle 500 into the first position (FIGS. 7-12) and insert nozzle 500 into channel 120 of constricting device 104. Alternatively, upon pad sensor 158 not detecting cleaning pad 102, an input signal is transmitted to electronic controller 160. Upon receipt of this input signal, electronic controller 160 generates an output signal and transmits the output signal to the programmable controller of the robotic arm, instructing the robotic arm to move nozzle 500 into the second position (FIG. 5) where contact between nozzle 500 and cleaning pad 102 is reestablished to adhere cleaning pad 102 to tip 504 of nozzle 500.

In an example implementation, the steps of detecting cleaning pad 102 and reestablishing contact between cleaning pad 102 and nozzle 500 to adhere cleaning pad 102 to nozzle 500 may be repeated a predetermined number of times before a system fault is generated. As an example, after a third unsuccessful attempt to adhere cleaning pad 102 to tip 504 of nozzle 500 and a corresponding third failed detection of cleaning pad 102, electronic controller 160 may generate an output signal indicating that the system fault has occurred.

Referring generally to, e.g., FIGS. 1-5 and particularly to FIGS. 15A and 15B, according to method 1000, cleaning pad 102 is one of predetermined number of cleaning pads 103 (block 1024). Method 1000 further comprises (block 1026) arranging predetermined number of cleaning pads 103 in a stacked configuration. Method 1000 also comprises (block 1028) determining when predetermined number of cleaning pads 103 has been consumed. Method 1000 additionally comprises (block 1030) generating a first signal when predetermined number of cleaning pads 103 has been consumed. The preceding subject matter of this paragraph characterizes example 36 of the present disclosure, wherein example 36 also includes the subject matter according to any one of examples 32 to 35, above.

Determining when predetermined number of cleaning pads 103 has been consumed and generating a first signal when predetermined number of cleaning pads 103 has been consumed provides a system alert that additional cleaning pads are needed.

Referring to FIGS. 1-5, in an example implementation, upon a determination that predetermined number of cleaning pads 103 has been consumed, electronic controller 160 generates first signal indicating that predetermined number of cleaning pads 103 has been consumed. As an example, first signal may trigger the system alert to refill platform 114 with a subsequent predetermined number of cleaning pads 103.

Referring generally to, e.g., FIGS. 1-5 and particularly to FIGS. 15A and 15B, according to method 1000, determining when predetermined number of cleaning pads 103 has been consumed comprises (block 1032) detecting when platform 114 supporting predetermined number of cleaning pads 103 reaches a fully extended position. The preceding subject matter of this paragraph characterizes example 37 of the present disclosure, wherein example 37 also includes the subject matter according to example 36, above.

Detecting when platform 114 supporting predetermined number of cleaning pads 103 reaches its fully extended position provides a means for generating the first signal indicating that predetermined number of cleaning pads 103 has been consumed.

Referring to FIGS. 1-5, in an example implementation, platform 114 is in its fully extending position when linear actuator 148 is in its fully extended position. Upon platform 114 reaching its fully extended position, second position sensor 154 is actuated. Actuation of second position sensor 154 generates an input signal to electronic controller 160. Upon receipt of this input signal, electronic controller 160 generates the first signal that provides the system alert that predetermined number of cleaning pads 103 supported on platform 114 has been consumed.

Referring generally to, e.g., FIGS. 1-6 and particularly to FIGS. 15A and 15B, according to method 1000, determining when predetermined number of cleaning pads 103 has been consumed comprises (block 1034) counting a number of times constricting device 104 circumferentially squeezes cleaning pad 102 around nozzle 500 and (block 1036) comparing the number of times constricting device 104 circumferentially squeezes cleaning pad 102 around nozzle 500 to predetermined number of cleaning pads 103. The first signal, indicating that the predetermined number of cleaning pads 103 has been consumed, is generated when the number of times constricting device 104 circumferentially squeezes cleaning pad 102 around nozzle 500 is equal to predetermined number of cleaning pads 103 (block 1038). The preceding subject matter of this paragraph characterizes example 38 of the present disclosure, wherein example 38 also includes the subject matter according to example 36, above.

Counting the number of times constricting device 104 circumferentially squeezes cleaning pad 102 around nozzle 500 provides a means for generating the first signal indicating that predetermined number of cleaning pads 103 has been consumed.

Referring to FIGS. 1-5, in an example implementation, electronic controller 160 tracks and maintains the number of times (e.g., a running tally each time) constricting device 104 circumferentially squeezes cleaning pad 102 around nozzle 500. As an example, electronic controller 160 counts the number of times (e.g., each time) constricting member 118 moves into the closed position. Following each time constricting device 104 circumferentially squeezes cleaning pad 102 around nozzle 500 (e.g., each time constricting member 118 moves into the closed position), electronic controller 160 compares the tallied number to predetermined number of cleaning pads 103. When the number of times constricting device 104 circumferentially squeezes cleaning pad 102 around nozzle 500 (e.g., the number of times constricting member 118 moves into the closed position) is equal to predetermined number of cleaning pads 103, electronic controller 160 generates first signal that provides the system alert that predetermined number of cleaning pads 103 supported on platform 114 has been consumed.

Alternatively, the first signal may indicate that the predetermined number of cleaning pads 103 is partially consumed or is approaching being completely consumed. As an example, following each time constricting device 104 circumferentially squeezes cleaning pad 102 around nozzle 500 (e.g., each time constricting member 118 moves into the closed position), electronic controller 160 compares the tallied number to of times constricting device 104 circumferentially squeezes cleaning pad 102 around nozzle 500 (e.g., the number of times constricting member 118 moves into the closed position) to a number less than predetermined number of cleaning pads 103. For example, the number may be N−1, N−2, etc., wherein N is predetermined number of cleaning pads 103. In this example, first signal is generated when the number of times constricting device 104 circumferentially squeezes cleaning pad 102 around nozzle 500 is less than predetermined number of cleaning pads 103.

Referring generally to, e.g., FIGS. 1-4 and particularly to FIGS. 15A and 15B, method 1000 further comprises (block 1040) determining when disposal receptacle 106 is full. Method 1000 further comprises (block 1042) generating a second signal when disposal receptacle 106 is full. The preceding subject matter of this paragraph characterizes example 39 of the present disclosure, wherein example 39 also includes the subject matter according to any one of examples 32 to 38, above.

Determining when disposal receptacle 106 is full and generating a second signal when disposal receptacle 106 is full provides a system alert that disposal receptacle 106 needs to be emptied.

Referring to FIGS. 1-4, in an example implementation, upon a determination that disposal receptacle 106 is full, electronic controller 160 generates second signal indicating that disposal receptacle 106 is full. As an example, second signal may trigger the system alert to empty disposal receptacle 106.

Referring generally to, e.g., FIGS. 1-4 and particularly to FIGS. 15A and 15B, according to method 1000, determining when disposal receptacle 106 is full comprises (block 1044) counting a number of times constricting device 104 circumferentially squeezes cleaning pad 102 around nozzle 500 and (block 1046) comparing the number of times constricting device 104 circumferentially squeezes cleaning pad 102 around nozzle 500 to predetermined number of used cleaning pads 107. The second signal, indicating that disposal receptacle 106 is full, is generated when the number of times constricting device 104 circumferentially squeezes cleaning pad 102 around nozzle 500 is equal to predetermined number of used cleaning pads 107 (block 1048). The preceding subject matter of this paragraph characterizes example 40 of the present disclosure, wherein example 40 also includes the subject matter according to example 39, above.

Counting the number of times constricting device 104 circumferentially squeezes cleaning pad 102 around nozzle 500 provides a means for generating the second signal indicating that disposal receptacle 106 is full.

Referring to FIGS. 1-4, in an example implementation, electronic controller 160 tracks and maintains the number of times (e.g., a running tally each time) constricting device 104 circumferentially squeezes cleaning pad 102 around nozzle 500. As an example, electronic controller 160 counts the number of times (e.g., each time) constricting member 118 moves into the closed position. Following each time constricting device 104 circumferentially squeezes cleaning pad 102 around nozzle 500 (e.g., each time constricting member 118 moves into the closed position), electronic controller 160 compares the tallied number to predetermined number of used cleaning pads 107. Predetermined number of used cleaning pads 107 may be the number of used cleaning pads 107 that fills disposal receptacle 106. When the number of times constricting device 104 circumferentially squeezes cleaning pad 102 around nozzle 500 (e.g., the number of times constricting member 118 moves into the closed position) is equal to predetermined number of used cleaning pads 107, electronic controller 160 generates first signal that provides the system alert that disposal receptacle 106 is full.

Referring generally to, e.g., FIGS. 1-4, 7 and 8 and particularly to FIGS. 15A and 15B, according to method 1000, circumferentially squeezing cleaning pad 102 around nozzle 500 with constricting device 104 comprises (block 1050) stretching constricting member 118 of constricting device 104 into a closed position. The preceding subject matter of this paragraph characterizes example 41 of the present disclosure, wherein example 41 also includes the subject matter according to any one of examples 32 to 40, above.

Stretching constricting member 118 into closed position allows for active movement (e.g., stretching) into the closed position and passive, automatic movement (e.g., springing back) back into the open position.

Referring to FIGS. 1-4, 7 and 8, in an example implementation, when nozzle 500 is positioned in the first position, an input signal is transmitted to electronic controller 160, for example, provided by the programmable controller of the robotic arm. Upon receipt of this input signal, electronic controller 160 generates an output signal and transmits the output signal to pneumatic controller 162, instructing one or more of the plurality of pneumatic control valve actuators (e.g., actuator 124) to initiate a forced flow of compressed air to actuator 124, for example, from compressed-air source 202, in order to produce the positive pressure within chamber 132 and stretch elastic membrane 130 into the closed position. Insertion of nozzle 500 into channel 120 of constricting device 104 positions cleaning pad 102 between elastic membrane 130 and exterior 512 of nozzle 500. Stretching elastic membrane 130 into the closed position circumferentially squeezes cleaning pad 102 around exterior 512 of nozzle 500. With elastic membrane 130 in the closed position and cleaning pad 102 circumferentially squeezed around nozzle 500, nozzle 500 is then withdrawn from elastic membrane 130 such that cleaning pad 102 removes residue 508 from exterior 512 and/or tip 504 of nozzle 500. Following removal of nozzle 500 from within constricting device 104, an input signal is transmitted to electronic controller 160, for example, provided by the programmable controller of the robotic arm. Upon receipt of this input signal, electronic controller 160 generates an output signal and transmits the output signal to pneumatic controller 162, instructing one or more of the plurality of pneumatic control valve actuators (e.g., actuator 124) to cease the forced flow of compressed air into chamber 132 in order to allow elastic membrane 130 to automatically return to the open position.

Referring generally to, e.g., FIGS. 1-4, 9 and 10 and particularly to FIGS. 15A and 15B, according to method 1000, circumferentially squeezing cleaning pad 102 around nozzle 500 with constricting device 104 comprises (block 1052) inflating constricting member 118 of constricting device 104 into a closed position. The preceding subject matter of this paragraph characterizes example 42 of the present disclosure, wherein example 42 also includes the subject matter according to any one of examples 32 to 40, above.

Inflating constricting member 118 into closed position allows for active movement (e.g., inflating) into the closed position and passive, automatic movement (e.g., deflating) back into the open position.

Referring to FIGS. 1-4, 9 and 10, in an example implementation, when nozzle 500 is positioned in the first position, an input signal is transmitted to electronic controller 160, for example, provided by the programmable controller of the robotic arm. Upon receipt of this input signal, electronic controller 160 generates an output signal and transmits the output signal to pneumatic controller 162, instructing one or more of the plurality of pneumatic control valve actuators (e.g., actuator 124) to initiate a forced flow of compressed air to actuator 124, for example, from compressed-air source 202, in order to produce the positive pressure within interior 138 of flexible bag 134 and inflate flexible bag 134 into the closed position. Insertion of nozzle 500 into channel 120 of constricting device 104 positions cleaning pad 102 between flexible bag 134 and exterior 512 of nozzle 500. Inflating flexible bag 134 into the closed position circumferentially squeezes cleaning pad 102 around exterior 512 of nozzle 500. With flexible bag 134 in the closed position and cleaning pad 102 circumferentially squeezed around nozzle 500, nozzle 500 is then withdrawn from flexible bag 134 such that cleaning pad 102 removes residue 508 from exterior 512 and/or tip 504 of nozzle 500. Following removal of nozzle 500 from within constricting device 104, an input signal is transmitted to electronic controller 160, for example, provided by the programmable controller of the robotic arm. Upon receipt of this input signal, electronic controller 160 generates an output signal and transmits the output signal to pneumatic controller 162, instructing one or more of the plurality of pneumatic control valve actuators (e.g., actuator 124) to cease the forced flow of compressed air into interior 138 of flexible bag 134 in order to allow flexible bag 134 to automatically return to the open position.

Referring generally to, e.g., FIGS. 1-4, 11 and 12 and particularly to FIGS. 15A and 15B, according to method 1000, circumferentially squeezing cleaning pad 102 around nozzle 500 with constricting device 104 comprises (block 1054) expanding constricting member 118 of constricting device 104 into a closed position. The preceding subject matter of this paragraph characterizes example 43 of the present disclosure, wherein example 43 also includes the subject matter according to any one of examples 32 to 40, above.

Expanding constricting member 118 into closed position allows for controlled, active movement (e.g., expanding) into the closed position and controlled, active movement (e.g., retracting) back into the open position.

Referring to FIGS. 1-4, 11 and 12, in an example implementation, when nozzle 500 is positioned in the first position, an input signal is transmitted to electronic controller 160, for example, provided by the programmable controller of the robotic arm. Upon receipt of this input signal, electronic controller 160 generates an output signal and transmits the output signal to pneumatic controller 162, instructing one or more of the plurality of pneumatic control valve actuators (e.g., actuator 124) to initiate a forced flow of compressed air to actuator 124, for example, from compressed-air source 202, in order to produce the positive pressure within interior 140 of bellows 136 and expand bellows 136 into the closed position. Insertion of nozzle 500 into channel 120 of constricting device 104 positions cleaning pad 102 between bellows 136 and exterior 512 of nozzle 500. Expanding bellows 136 into the closed position circumferentially squeezes cleaning pad 102 around exterior 512 of nozzle 500. With bellows 136 in the closed position and cleaning pad 102 circumferentially squeezed around nozzle 500, nozzle 500 is then withdrawn from bellows 136 such that cleaning pad 102 removes residue 508 from exterior 512 and/or tip 504 of nozzle 500. Following removal of nozzle 500 from within constricting device 104, an input signal is transmitted to electronic controller 160, for example, provided by the programmable controller of the robotic arm. Upon receipt of this input signal, electronic controller 160 generates an output signal and transmits the output signal to pneumatic controller 162, instructing one or more of the plurality of pneumatic control valve actuators (e.g., actuator 124) to initiate a forced withdrawal of air, for example, from vacuum source 204, in order to produce the negative pressure within interior 140 of bellows 136 and retract bellows 136 back to the open position.

Referring generally to, e.g., FIGS. 1-4, 13 and 14 and particularly to FIGS. 15A and 15B, according to method 1000, circumferentially squeezing cleaning pad 102 around nozzle 500 with constricting device 104 comprises (block 1056) reciprocating constricting member 118 of constricting device 104 into a closed position. The preceding subject matter of this paragraph characterizes example 44 of the present disclosure, wherein example 44 also includes the subject matter according to any one of examples 32 to 40, above.

Reciprocating constricting member 118 into closed position allows for controlled, active movement (e.g., inward rotation) into the closed position and controlled, active movement (e.g., outward rotation) back into the open position.

Referring to FIGS. 1-4, 13 and 14, in an example implementation, when nozzle 500 is positioned in the first position, an input signal is transmitted to electronic controller 160, for example, provided by the programmable controller of the robotic arm. Upon receipt of this input signal, electronic controller 160 generates an output signal and transmits the output signal to actuator 124 to produce one of linear motion or rotary motion in order to rotate, or pivot, plurality of leaves 142 radially inward into the closed position. Insertion of nozzle 500 into channel 120 of constricting device 104 positions cleaning pad 102 between plurality of leaves 142 and exterior 512 of nozzle 500. Pivoting plurality of leaves 142 into the closed position circumferentially squeezes cleaning pad 102 around exterior 512 of nozzle 500. With plurality of leaves 142 in the closed position and cleaning pad 102 circumferentially squeezed around nozzle 500, nozzle 500 is then withdrawn from bellows 136 such that cleaning pad 102 removes residue 508 from exterior 512 and/or tip 504 of nozzle 500. Following removal of nozzle 500 from within constricting device 104, an input signal is transmitted to electronic controller 160, for example, provided by the programmable controller of the robotic arm. Upon receipt of this input signal, electronic controller 160 generates an output signal and transmits the output signal to actuator 124 to produce one of linear motion or rotary motion in order to counter-rotate, or pivot, plurality of leaves 142 radially outward into the open position.

Examples of the present disclosure may be described in the context of aircraft manufacturing and service method 1100 as shown in FIG. 16 and aircraft 1102 as shown in FIG. 17. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 17, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. An apparatus for removing a residue of a substance, extrudable through a nozzle of an automated end-effector, from an exterior of the nozzle, the apparatus comprising:

a dispenser, comprising:

a platform to support at least one cleaning pad; and a cage to maintain at least the one cleaning pad on the platform, wherein the platform is movable relative to the cage;

a constricting device to circumferentially squeeze one of at least the one cleaning pad, adhesively picked up from the platform by the nozzle, around the nozzle once the nozzle is inserted into the constricting device; and a disposal receptacle to collect the one of at least the one cleaning pad, released from the constricting device.

2. The apparatus according to claim 1, wherein the constricting device comprises:

a housing, comprising a first end, a second end, and a channel, extending from the first end to the second end; and a constricting member, coupled to the housing and forming at least a portion of a periphery of the channel, wherein the constricting member is movable, relative to the housing, between an open position to receive the nozzle, with the one of at least the one cleaning pad adhered thereto, and a closed position to circumferentially squeeze the one of at least the one cleaning pad around of the nozzle.

3. The apparatus according to claim 2, further comprising an actuator, operatively coupled to the constricting device, and wherein the actuator moves the constricting member into the closed position.

4. The apparatus according to claim 3, wherein the constricting member automatically returns to the open position.

5. The apparatus according to claim 3, wherein the constricting member stretches into the closed position and springs back to the open position.

6. The apparatus according to claim 3, wherein:

the constricting member comprises an elastic membrane, connected to the housing;

a chamber is formed between the elastic membrane and the housing; and the actuator forces air within the chamber to stretch the elastic membrane into the closed position.

7. The apparatus according to claim 6, wherein the elastic membrane is made of latex.

8. The apparatus according to claim 3, wherein the constricting member is inflatable into the closed position and is deflatable into the open position.

9. The apparatus according to claim 3, wherein:

the constricting member comprises a flexible bag, connected to the housing; and the actuator forces air within an interior of the flexible bag to inflate the flexible bag into the closed position.

10. The apparatus according to claim 3, wherein the actuator moves the constricting member into the open position.

11. The apparatus according to claim 10, wherein the constricting member is expandable into the closed position and is retractable into the open position.

12. The apparatus according to claim 10, wherein:

the constricting member comprises a bellows, connected to the housing;

the actuator is configured to force air within an interior of the bellows to expand the bellows into the closed position; and the actuator is configured to withdraw the air from within the interior of the bellows to retract the bellows into the open position.

13. The apparatus according to claim 10, wherein the constricting member is configured to reciprocate between the open position and the closed position.

14. The apparatus according to claim 10, wherein:

the constricting member comprises a plurality of leaves, arranged in a circular pattern and pivotally connected to the housing;

the actuator is configured to simultaneously rotate the plurality of leaves into the closed position; and the actuator is configured to simultaneously counter-rotate the plurality of leaves into the open position.

15. The apparatus according to claim 10, wherein the actuator comprises a pneumatic control valve actuator to produce a positive pressure to move the constricting member into the closed position.

16. The apparatus according to claim 15, wherein the actuator produces a negative pressure to move the constricting member into the open position.

17. The apparatus according to claim 10, wherein the actuator comprises one of a mechanical actuator or a pneumatic actuator to produce one of linear motion or rotary motion to move the constricting member between the open position and the closed position.

18. The apparatus according to claim 2, further comprising an air amplifier in fluid communication with the channel of the constricting device, wherein the air amplifier is configured to withdraw the one of at least the one cleaning pad from within the channel and to ejects the one of at least the one cleaning pad into the disposal receptacle.

19. The apparatus according to claim 1, wherein the dispenser further comprises a linear actuator, connected to the platform to linearly move at least the one cleaning pad, supported on the platform, into contact with the nozzle.

20. The apparatus according to claim 1, wherein the dispenser further comprises at least one position sensor to determine at least one position of the platform.

* * * * *